US006873103B2

(12) United States Patent
Takada et al.

(10) Patent No.: US 6,873,103 B2
(45) Date of Patent: Mar. 29, 2005

(54) GAS DISCHARGE PANEL

(75) Inventors: Yuusuke Takada, Katano (JP); Toru Ando, Osaka (JP); Nobuaki Nagao, Katano (JP); Hidetaka Higashino, Souraku-gun (JP); Masaki Nishimura, Takatuki (JP); Ryuichi Murai, Toyonaka (JP); Yoshio Watanabe, Ibaraki (JP); Naoki Kosugi, Kyoto (JP); Hiroyuki Tachibana, Toyonaka (JP); Koichi Wani, Toronto (CA)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 73 days.

(21) Appl. No.: 10/362,306

(22) PCT Filed: Aug. 27, 2001

(86) PCT No.: PCT/JP01/07297

§ 371 (c)(1),
(2), (4) Date: Jul. 21, 2003

(87) PCT Pub. No.: WO02/19367

PCT Pub. Date: Mar. 7, 2002

(65) Prior Publication Data

US 2004/0041522 A1 Mar. 4, 2004

(30) Foreign Application Priority Data

| | | |
|---|---|---|
| Aug. 29, 2000 | (JP) | 2000-258653 |
| Aug. 29, 2000 | (JP) | 2000-258656 |
| Oct. 11, 2000 | (JP) | 2000-310412 |

(51) Int. Cl.[7] ..... H01J 17/49
(52) U.S. Cl. ..... 313/582; 313/584
(58) Field of Search ..... 313/484, 491, 313/581, 582, 584, 587

(56) References Cited

U.S. PATENT DOCUMENTS 5,736,815 A 4/1998 Amemiya

FOREIGN PATENT DOCUMENTS

| | | |
|---|---|---|
| EP | 0 762 463 A2 | 3/1997 |
| JP | 2-148646 | 6/1990 |
| JP | 05-041166 | 2/1993 |
| JP | 08-315735 | 11/1996 |
| JP | 9-35644 | 2/1997 |
| JP | 9-129142 | 5/1997 |
| JP | 9-283030 | 10/1997 |
| JP | 10-149774 | 6/1998 |
| JP | 10-321148 | 12/1998 |
| JP | 11-120922 | 4/1999 |
| JP | 11-213896 | 8/1999 |
| JP | 2001-250484 | 9/2001 |

*Primary Examiner*—Vip Patel

(57) ABSTRACT

A gas discharge panel having plural pairs of display electrodes disposed so as to extend through a plurality of cells, each pair being formed from a sustain electrode and a scan electrode. The sustain and scan electrodes each include a plurality of line parts, and an aggregate width of the line parts included in the sustain and scan electrodes is in a range of 22% to 48% inclusive of pixel pitch.

34 Claims, 32 Drawing Sheets

FIG.9

【measured data】

| A / B (%) | reflected brightness of external light (cd / m²) |
|---|---|
| 50 | 2.5 |
| 70 | 2.4 |
| 80 | 2.5 |
| 90 | 2.5 |
| 95 | 2.7 |
| 100 | 3.1 |
| 105 | 3.6 |
| 115 | 4.6 |
| 140 | 9.8 |

GAS DISCHARGE PANEL

TECHNICAL FIELD

The present invention relates to gas discharge panels such as plasma display panels.

BACKGROUND ART

Plasma display panels (PDPs) are one type of gas discharge panel, and they are attracting attention as the display panels of the future due to their short depth and the comparative ease with which screen size can be increased. At present, 60-inch class models are available on the market.

FIG. 28 is a partial cross-sectional perspective view of a main structure of a conventional AC-type surface discharge PDP. In FIG. 28, the z direction corresponds to a thickness of the PDP, and the xy plane corresponds to a plane that is parallel with a panel surface of the PDP. As shown in FIG. 28, PDP 1 is structured from a front panel FP and a back panel BP that are arranged with main surfaces facing each other.

On a main surface of a front panel glass 2 that forms a substrate of front panel FP, plural pairs of display electrodes 4 and 5 (scan electrode 4, sustain electrode 5) are structured in the x direction, so as to conduct a surface discharge between each pair of display electrodes 4 and 5. Here, display electrodes 4 and 5 are, for example, made from a mixture of Ag and glass.

Scan electrodes 4 are each electrically independent, and power is supplied separately. Sustain electrodes 5 are all electrically connected to the same potential.

On the main surface of front panel glass 2 on which display electrode 4 and 5 are arranged, a dielectric layer 6 made from an insulating material, and a protective layer 7 are coated in the stated order.

On a main surface of back panel glass 3 that forms a substrate of back panel BP, a plurality of address electrodes 11 are arranged in a stripe pattern so as to extend in the y direction. These address electrodes are made from a mixture of Ag and glass.

On the main surface of back panel glass 3 on which address electrodes 11 are arranged, a dielectric layer 10 made from an insulating material is coated. On dielectric layer 10, barrier ribs 8 are arranged to correspond to the gap between two adjacent address electrodes 11. On the walls of barrier ribs 8 and on the surface of dielectric layer 10 between any two adjacent barrier ribs 8 are formed phosphor layers 9R, 9G and 9B corresponding to the colors red (R), green (G), and blue (B).

Here, a width in the x direction of phosphor layers 9R, 9G and 9B is shown in FIG. 28 as being the same, although in order to achieve brightness balance among the colors, the phosphor layers corresponding to one or more of the colors may be widened in comparison to the other phosphor layers.

Front panel FP and back panel BP structured as described above are positioned facing one another so that a lengthwise direction of address electrodes 11 is orthogonal to a lengthwise direction of display electrodes 4 and 5.

Front panel FP and back panel BP are sealed together around their periphery using a sealing material such as frit glass, and the space between the two panels is made airtight.

The space between the sealed panels is then filled at a predetermined pressure (conventionally approx. 40 kPa–66.5 kPa) with a discharge gas that includes Xe.

As a result, the space portioned between dielectric layer 6, phosphor layers 9R, 9G and 9B, and adjacent barrier ribs 8 in the sealed front and back panels is formed as discharge space 38. Furthermore, the areas where a pair of display electrodes 4 and 5 extend orthogonally across an address electrode 11 with a discharge space 38 therebetween are formed as cells (not depicted) that relate to image display. Here, FIG. 29 shows a matrix formed from plural pairs of display electrodes 4 and 5 (N rows) and a plurality of address electrodes (M columns) in a PDP.

When the PDP is driven, a discharge is initiated between the address electrode and one of the display electrodes in each cell, short-wave ultraviolet rays are generated as a result of a discharge that occurs between the display electrodes in each pair, and phosphor layers 9R, 9G and 9B illuminate visible light when struck by the ultraviolet rays. Image display is thus achieved.

Next, a drive method for a prior art PDP will be described in detail with reference to FIGS. 30 and 31.

FIG. 30 is a conceptual block view of an image display device that uses the prior art PDP, and FIG. 31 shows exemplary drive waveforms applied to the electrodes in the panel.

As shown in FIG. 30, for driving the PDP, PDP display apparatus includes a frame memory 100, an output processing circuit 110, an address electrode drive circuit 120, a sustain electrode drive circuit 130, and a scan electrode drive circuit 140. Electrodes 4, 5 and 11 are connected to circuits 140, 130 and 120, respectively, and circuits 120, 130 and 140 are connected to output processing circuit 110.

When the PDP is driven, image information from an external source is temporality stored in frame memory 100, and then in accordance with timing information, the stored image information is sent from frame memory 100 to output processing circuit 110. Output processing circuit 110, which is driven in accordance with the image information and timing information, issues instructions to circuits 120, 130 and 140 to apply pulse voltages to electrodes 4, 5 and 11, and image display is achieved as a result.

As shown in FIG. 31, according to this drive method for the PDP, image display is achieved by conducting a consecutive sequence of periods that include an initialization period, a write period, a sustain period, and an erase period.

To display a television image, the image according to the NTSC standard is structured from 60 fields per second. Plasma display panels are fundamentally only capable of expressing the two gradations of ON and OFF. Thus to express the intermediate colors, the ON period of each of the colors red (R), green (G) and blue (B) is time divided, a single field is divided into a plurality of subfields, and the intermediate colors are expressed by varying the combination of subfields.

FIG. 32 shows a method for dividing a single field into subfields to express 256 gray levels in a prior art AC-type PDP. Here, the weighting of the subfields is conducted in binary, with the ratio of sustain pulses applied during the sustain period of the subfields being 1, 2, 4, 8, 16, 32, 64 and 128, respectively. The 256 gray levels are expressed by varying the combination of these eight bits.

When the PDP is driven, an initialization pulse is applied in each subfield to scan electrodes 4, and the wall charge in the cells of the panel is initialized. Next, writing is conducted by applying a scan pulse to the upper most (i.e. at the top of the display) scan electrode in the y direction, and applying a write pulse to address electrodes in cells for display that include the upper most scan electrode. As a result, wall charge is stored on the surface of dielectric layer 6 in cells corresponding to the scan and address electrodes to which the scan and address pulses are applied.

Next, in the same manner as described above, a scan pulse is applied respectively to the scan electrode subsequent to the uppermost scan electrode, and a write pulse is applied to address electrodes in cells for display, thus storing wall charge on the surface of dielectric layer 6 corresponding to these cells. This process is conducted for all of the display electrodes in the panel, and this results in the writing of one screen of latent image.

Next, a sustain discharge is conducted by grounding address electrodes 11 and applying a sustain pulse alternately to scan electrodes 4 and sustain electrodes 5. A discharge is generated in cells storing wall charge on the surface of dielectric layer 6 from the write discharge, because of the potential of the surface of dielectric layer 6 rising above a discharge sparking voltage, and for the duration (sustain period) that the sustain pulse is applied, a sustain discharge occurs in display cells to which the write pulse was selectively applied. In each of the cells during the sustain discharge, a discharge is initiated between the address electrode and one of the scan electrode and the sustain electrode, and this discharge results in the generation of short-wave ultraviolet rays (Xe resonance line; wavelength approx. 147 nm), which in turn strike and excite phosphor layers 9R, 9G, and 9B to illuminate visible light. Image display is achieved as a result.

An unstable discharge is then generated by applying an erase pulse having a narrow pulse width, and this serves to eliminate the wall charge and erase the image.

Today, however, there is a demand for electrical appliances that suppress power consumption as much as possible, and thus interest is focused on reducing the power required to drive PDPs. The demand for technology that realizes power reductions is all the more urgent given the tendency for increased power consumption in recently developed PDPs, due to the larger screen sizes and image definition improvements. Moreover, the demand for reliable image display capabilities in PDPs remains a fundamental issue.

As such, the aim is to achieve reductions in power consumption while at the same time maintaining reliable driving and luminescence brightness levels. In other words, improvements in luminescence efficiency are desired.

In order to improve luminescence efficiency, research is currently being conducted, for example, into improving the efficiency with which phosphors convert ultraviolet rays into visible light, although still further improvements in luminescence efficiency are desirable.

Furthermore, in order to suppress the discharge voltage to an appropriate level while at the same time increasing panel brightness, conventional technology (e.g. see Japanese patent no. 2,734,405) has involves the use, for example, of electrode configurations in which openings are provided, or in which the display electrodes are partially divided. However, depending on the surface area of the divided electrodes, the discharge voltage maybe suppressed too much, or brightness may be reduced. The above problems are further exacerbated when there is a variation in the size of the electrodes.

To counter these problems, current flow can be maintained by providing wide bus electrodes, although because the bus parts themselves block the generated luminescence, the problem becomes one of maintaining brightness levels. Also, when the width of bus electrodes or a surface area of electrodes positioned farthest from a main electrode gap is increased, not only is the distance between adjacent cells reduced, but the accumulation of wall charge tends to occur away from the center of the cells, and thus crosstalk and other undesirable discharges can easily occur. Furthermore, reduction in the electrode surface area results in increases in the resistance value, and this can lead to problems of power loss.

Furthermore, with conventional structures, a lot of external light is reflected onto the panel surface because of the phosphor layers and barrier ribs being white, and thus, even when the darkroom contrast ratio is 500:1 or greater, the photopic contrast ratio drops to around 10:1. Conventional methods of solving this problem involve increasing the contrast by providing a black area (i.e. a so-called "black stripe") between adjacent discharge cells so as to increase the black surface area ratio (blackness ratio) per cell, or increasing the contrast ratio by providing a filter on the display surface.

Conventional display electrodes are, however, divided by function into transparent electrodes for increasing the amount of visible light recovered from the discharge, and bus electrodes for reducing the wiring resistance within the panel, and thus a common technique used to increase the contrast ratio is coloring the area between adjacent cells (including the bus electrode surface facing the substrate) black. The only way of coloring the surface of the bus electrodes facing the substrate black is either to use an electrode material that makes an substrate-side of the bus electrodes black, or to form a black material with dielectric qualities between the transparent electrode and the bus electrode as a black stripe. Furthermore, in order to also color the area between adjacent bus electrodes black and increase the blackness ratio, it is necessary to form a black material having different insulating qualities between the adjacent bus electrodes. Consequently, achieving a desired blackness ratio (contrast) leads to complications in the manufacturing process and increased material costs.

DISCLOSURE OF THE INVENTION

In view of the issues discussed above, a first object of the present invention is to provide a gas discharge panel with excellent display capacity in terms of brightness, luminescence efficiency, blackness ratio, and contrast.

Furthermore, a second object of the present invention is to provide a plasma display panel that employs an electrode configuration divided into a plurality of parts in order to suppress electrode resistance, reduce discharge current not effecting brightness, reduce power consumption without reducing brightness, and prevent crosstalk.

To resolve the above issues, the present invention is a gas discharge panel having plural pairs of display electrodes disposed so as to extend through a plurality of cells, each pair being formed from a sustain electrode and a scan electrode, the sustain and scan electrodes each including a plurality of line parts, and an aggregate width of the line parts included in the sustain and scan electrodes being in a range of 22% to 48% inclusive of pixel pitch.

The present invention may also be realized by a gas discharge panel having plural pairs of display electrodes disposed on a surface of a substrate, so as to extend through a plurality of cells, each pair being formed from a sustain electrode and a scan electrode, the sustain and scan electrodes each including a plurality of line parts, and a black film being formed on the surface of the substrate in a position corresponding to where the plurality of line parts will be disposed.

The present invention may further be realized by a gas discharge panel in which a plurality of cells having a discharge space are arranged in a matrix between a pair of substrates, and plural pairs of display electrodes are disposed on a facing surface of one of the substrates, so as to extend through the plurality of cells, each pair being formed from a sustain electrode and a scan electrode arranged with a discharge gap therebetween, a plurality of first barrier ribs being arranged side-by-side between the pair of substrates so as to extend in a row direction of the matrix, a second barrier rib being disposed between cells adjacent in the row direction of the matrix so as to extend along a column direction of the matrix, the sustain and scan electrodes each including a plurality of line parts that extend in the column direction of the matrix, and the second barrier rib and a line part farthest from the discharge gap being positioned so as to overlap with a space therebetween.

BRIEF DESCRIPTION OF THE DRAWINGS

FIG. 9 shows a relationship between the line part/black film thickness ratio and the reflected brightness of external light;

BEST MODE FOR CARRYING OUT THE INVENTION

Since the overall structure of a PDP according to the embodiments of the present invention is basically the same as the prior art described above, and since a characteristic of the present invention lies in a structure of the display electrodes, the ensuing description focuses on the display electrodes.

Embodiment 1

Figure 1:
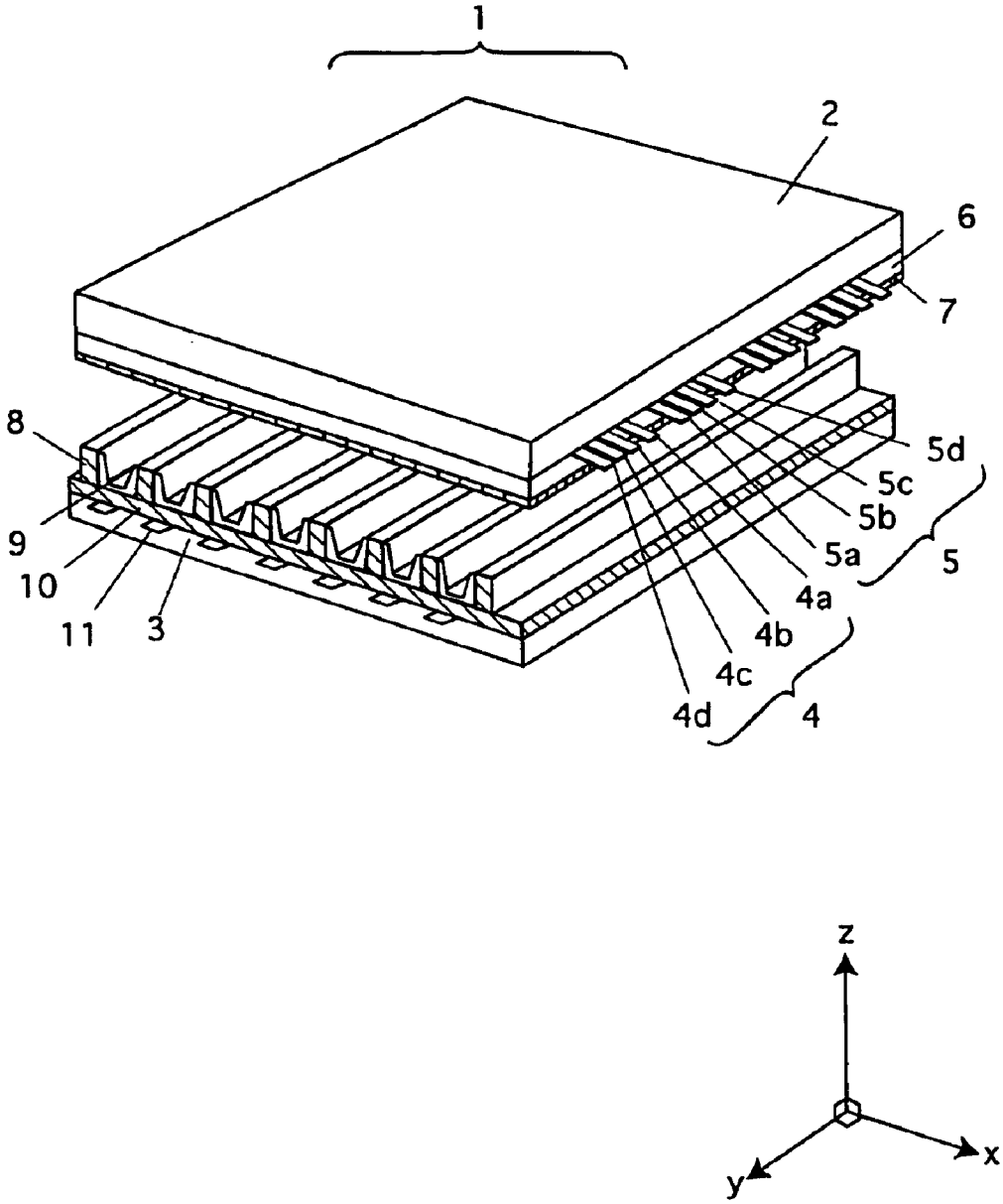
FIG. 1 is a perspective view of a PDP according to an embodiment 1.

FIG. 1 is a perspective view of an AC-type plasma display panel (hereafter "panel") according to an embodiment 1. As shown in FIG. 1, plural pairs of display electrodes 4 and 5 (scan electrode 4, sustain electrode 5) are disposed on a front panel (FP) of a panel 1, and the pairs of display electrodes are covered with a dielectric layer 6.

A single discharge cell corresponds to an area where a pair of display electrodes 4 and 5 extends across a single address electrode 11, and a single pixel is constituted by three discharge cells positioned adjacent in a direction (x direction) that is orthogonal to barrier ribs 8.

1-1. Display Electrode Configuration

Figure 2:
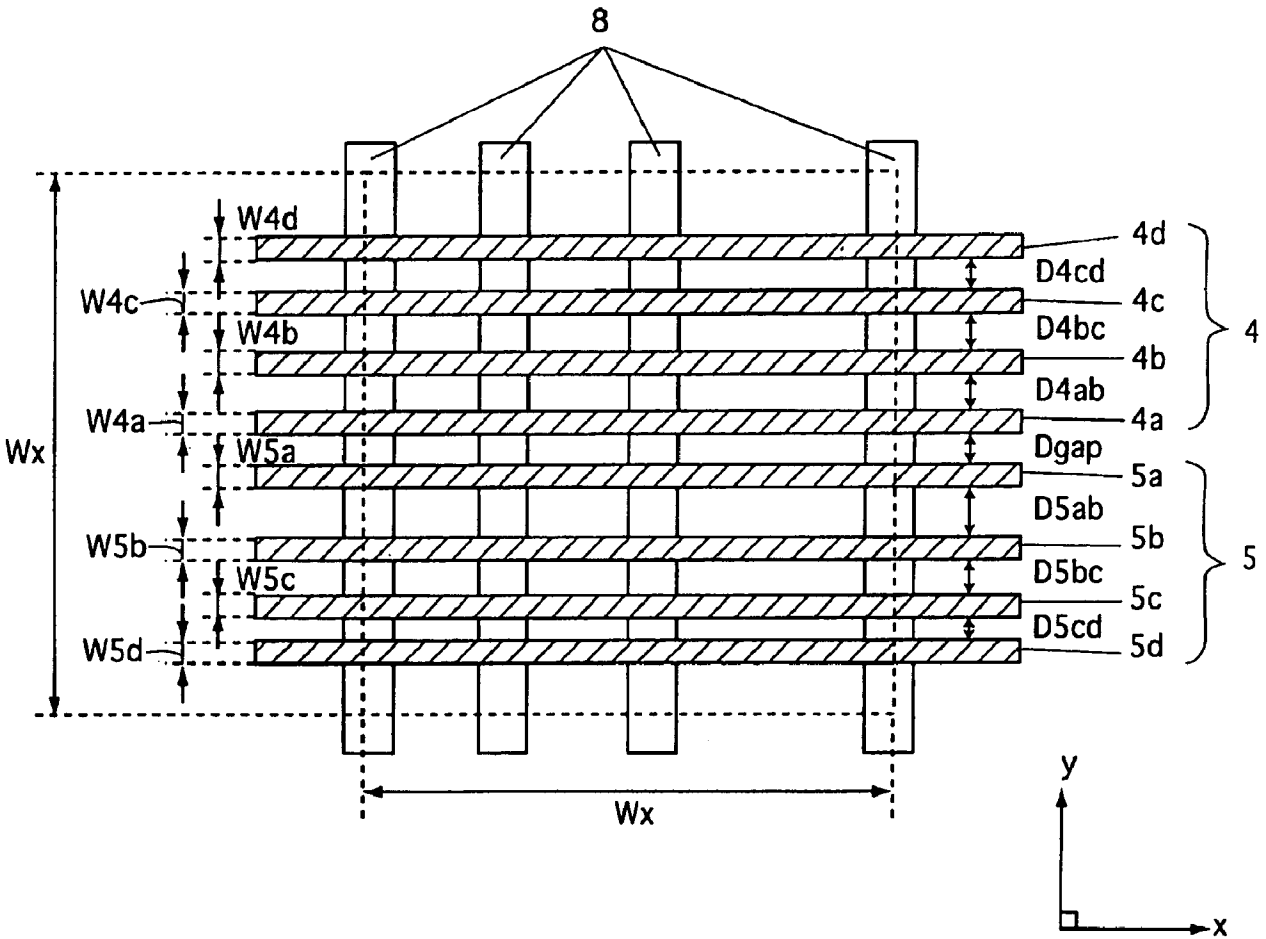
FIG. 2 is a plan view of display electrodes according to embodiment 1.

FIG. 2 is a plan view of a display electrode pattern according to embodiment 1.

As shown in FIG. 2, scan electrode 4 and sustain electrodes 5 are divided into a plurality of line parts 4*a* to 4*d*, and 5*a* to 5*d*, respectively. When a cell size is Wx×Wx (1080 μm×1080 μm), the number of line parts in both scan electrode 4 and sustain electrodes 5 preferably is at least four. As discussed below, this is to ensure that the gap between line parts is not too wide, and also to secure the discharge magnitude.

Line parts 4*a*–4*d* and 5*a*–5*d* are linear in shape and parallel to each other in a lengthwise direction (x direction) of scan electrode 4 and sustain electrode 5, respectively. This is to facilitate the process of fixing together of the FP and BP. However, the present invention only requires the setting of the aggregate surface area of the line parts with respect to a cell surface area, and thus no restrictions are placed on the shape of display electrodes 4 and 5.

An exemplary size of each of the line parts according to embodiment 1 is shown in Table 1; that is, a width (W4*a*–W4*d*, W5*a*–W5*d*) of line parts 4*a*–4*d* and 5*a*–5*d*, a gap (D4*ab*–D4*cd*, D5*ab*–D5*cd*) between line parts 4*a*–4*d* and 5*a*–5*d*, and a discharge gap Dgap, which is the gap between scan electrode 4 and sustain electrodes 5 (i.e. gap between line part 4*a* and line part 5*a*).

TABLE 1

| | Symbol | Design Value | Percentage of Pixel Pitch |
|---|---|---|---|
| Pixel Pitch | Wx | 1080 μm | 100.0% |
| Line Part Width | W4a, W5a | 40 μm | 3.7% |
| | W4b, W5b | 40 μm | 3.7% |
| | W4c, W5c | 40 μm | 3.7% |
| | W4d, W5d | 40 μm | 3.7% |
| Line Part Gap | D4ab, D5ab | 90 μm | 8.3% |
| | D4bc, D5bc | 70 μm | 6.5% |
| | D4cd, D5cd | 50 μm | 4.6% |
| Discharge Gap | Dgap | 80 μm | 7.4% |

Line parts 4*a*–4*b* and 5*a*–5*b* are each set to be 40 μm in width, and the gap between respective line parts is set to be in a range of 50 μm to 90 μm. Consequently, the aggregate width of all of line parts 4*a*–4*d*, 5*a*–5*d* is 320 μm, which is approximately 30% of the 1080 μm cell pitch. In the given example, the line parts 4*a*–4*d* and 5*a*–5*d* are linear in shape, and thus the sum of the surface areas of all the line parts amounts to approximately 30% of a single pixel having a 1080 μm×1080 μm surface area.

Figure 3:
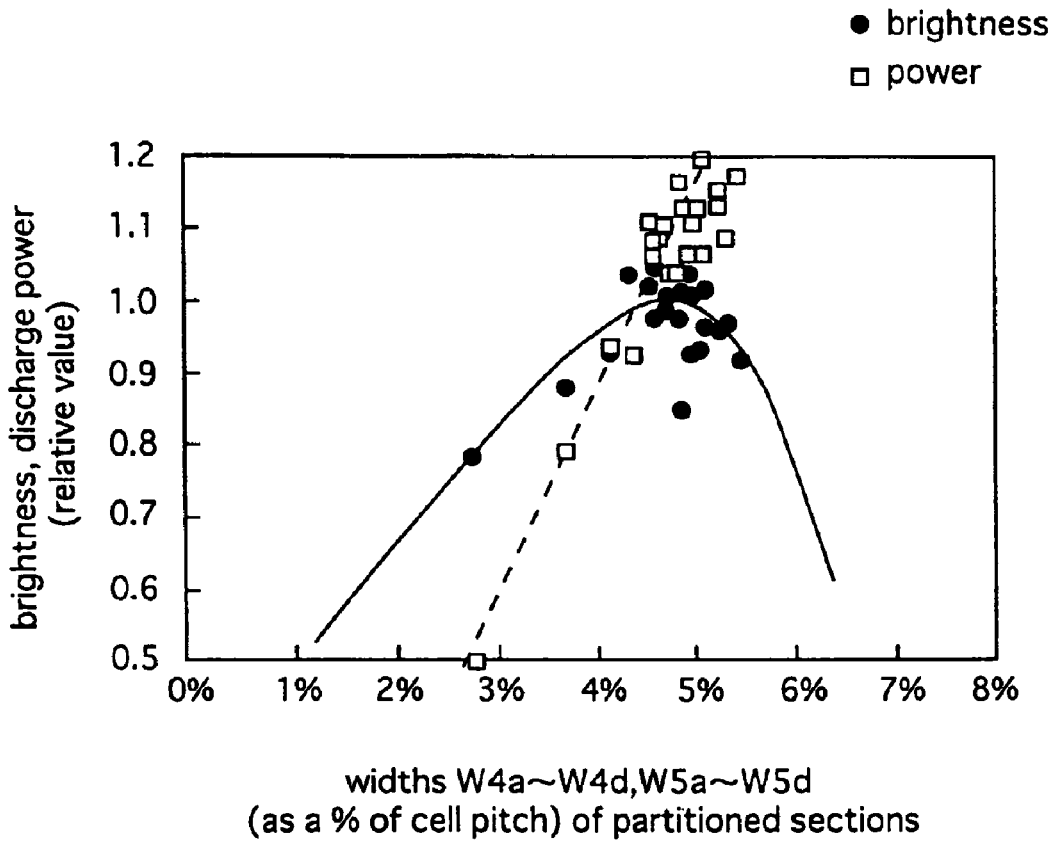
FIG. 3 shows brightness and discharge power in relation to a line part width.

FIG. 3 shows variations in brightness and discharge power when the widths W4*a*–W4*d* and W5*a*–W5*d* of line parts 4*a*–4*d* and 5*a*–5*d* are varied while maintaining a central position of line parts 4*a*–4*d* and 5*a*–5*d* fixed. Since the central position of each electrode is fixed, gaps D4*ab*–D4*cd* and D5*ab*–D5*cd* also vary in response to variations in the widths W4*a*–W4*d* and W5*a*–W5*d*. Here, the widths W4*a*–W4*d* and W5*a*–W5*d* are expressed as a ratio of cell pitch (1080 μm in the given example).

As shown in FIG. 3, increases in the line part width directly result in discharge current increases. This is attributed to the fact that current supply is increased when the electrode surface area contributing to the discharge is enlarged.

Since it is considered possible to maintain both the generation efficiency of ultraviolet rays resulting from a discharge and the conversion efficiency of visible light by the phosphors at a stable level, the enhanced generation of visible light resulting from a discharge when discharge power is increased should allow for improvements in brightness. In reality, however, increases in discharge power are not matched by corresponding increases in brightness, and in fact, brightness rapidly decreases when the widths W4*a*–W4*d* and W5*a*–W5*d* of line parts 4*a*–4*d* and 5*a*–5*d* each reach 5% or greater of cell pitch.

This is because a metallic material is used in forming line parts 4*a*–4*d* and 5*a*–5*d*, and thus increases in the line part width results in an expanded surface area blocking the generated visible light (i.e. reduction in width of the line part gaps D4*ab*–D4*cd* and D5*ab*–D5*cd*, and reduction in aperture ratio, both of which allow visible light to pass), and consequently the amount of visible light that reaches the panel display surface is reduced.

Given that the aim is to produce commercially marketable displays, it is not desirable to set the widths W4*a*–W4*d* and W5*a*–W5*d* of line parts 4*a*–4*b* and 5*a*–5*b* within a range that shows a tendency for reduced brightness with respect to inputted power. For instance, if widths W4*a*–W4*d* and W5*a*–W5*d* of line parts 4*a*–4*d* and 5*a*–5*d* are inconsistently produced in the manufacturing process, large variations in brightness will occur, resulting in products having greatly inconsistent brightness. An available means of realizing a product having greatly reduced power consumption and high brightness is to maintain brightness within a given standard (e.g. a shipping standard) and cut power consumption by making adjustments to the drive method (e.g. varying the number of pulses, etc).

To summarize the above points, in terms of the conversion efficiency to brightness with respect to power (i.e. luminescence efficiency), the narrower the line part width, the higher the brightness, although if a line part width falls below 2.8% of cell pitch, the voltage cannot be secured. On the other hand, if a line part width exceeds 6% of cell pitch, discharge efficiency is reduced. As such, a line part width of in a range of 2.8% to 6% is considered optimal for maximizing brightness within the given restrictions. Even more preferable is a range of 3% to 5%, within which brightness increases gradually in response to increases in the line part width.

In other words, since all of the line part widths according to this experiment were changed by the same amount, the aggregate width of the line parts of display electrodes 4 and 5 with respect to pixel pitch is preferably in a range of 22% to 48%, and is optimized in a range of 24% to 40%.

Furthermore, since the variation in brightness with respect to line part width is small within this range, there is little variation in brightness, even if variations in line part size occur during the manufacturing process.

Constituting some of line parts 4*a*–4*d* and 5*a*–5*d* as transparent electrodes is considered to be effective in eliminating reductions in brightness caused by the shading effect described above (reduction in aperture ratio) However, the resistance value of transparent electrodes is higher than metallic electrodes, and thus the overall resistance value of display electrodes 4 and 5 increases with increases in the number of line parts 4*a*–4*d* and 5*a*–5*d* constituted as transparent electrodes. An increased resistance value may invite not only resistance loss, but also bring about voltage drops somewhere within line parts 4*a*–4*d* and 5*a*–5*d*, and thus the voltage in a vicinity of the discharge gap in a cell positioned at a distance from the drive circuit may be reduced in comparison to the output from the circuit. This means that a higher voltage will be required to drive all the cells uniformly.

Furthermore, because the resistance value of transparent electrodes is higher than that of metallic electrodes, increases in current with respect to the surface area of line parts 4*a*–4*d* and 5*a*–5*d* is comparatively less for transparent electrodes, and the effect is also small. Consequently, the use of transparent electrode material is preferably restricted to the three line parts 4*a*–4*c* and 5*a*–5*c* closest to the discharge gap, while at least the line parts 4*d* and 5*d* positioned farthest from the discharge gap are preferably formed as metallic electrodes.

Here, if the display electrodes are wholly constituted as metallic electrodes, the process for forming transparent electrodes can be eliminated, and thus the overall number of processes can be reduced.

Here, line part gaps D4*ab*–D4*cd* and D5*ab*–D5*cd* are set to be in a range of 50 μm to 90 μm. Experimentation by the inventor revealed that drive voltage increases when line part gaps in excess of 110 μm are included. Consequently, line part gaps D4*ab*–D4*cd* and D5*ab*–D5*cd* of 110 μm and below are preferable (i.e. 10% and below of cell pitch in y direction)

1-3. Manufacturing Method for PDP

The following description relates to an exemplary manufacturing method for the PDP according to embodiment 1.

The manufacturing method given here is substantially the same as that for PDPs described in relation to other embodiments of the present invention.

1-3-1. Manufacture of Front Panel

Display electrodes are formed on a surface of a front panel made from soda lime glass of approximately 2.6 mm in thickness. Here, the given example relates to the display electrodes being formed (thick film formation method) as metallic electrodes using a metallic material (Ag).

First, a photosensitive paste is made by mixing a metallic (Ag) powder and an organic vehicle with a photosensitive resin (photodegradable resin). This paste is applied on a main surface of the front glass panel, and covered with a mask that is shaped in the pattern of the display electrodes to be formed. The masked paste is then exposed and developed/baked (baking temp. of approx. 590–600° C.). According to this method it is possible to form electrodes as thin as approximately 30 μm in width, in comparison to a conventionally used screen-printing method in which electrodes of no less than 100 μm in width are realizable. Moreover, other metallic material such as Pt, Au, Al, Ni, Cr, cassiterite, indium oxide, and the like may be used as the metallic material.

Furthermore, apart from the method described above, the display electrodes may be manufactured by using a vaporization method, a sputtering method or the like to firstly form a film from an electrode material, and then etching the film.

After forming the display electrodes, a glass paste is applied using a printing method or the like, and the glass paste is baked to form a dielectric layer.

Next, a protective layer of approximately 0.3 μm to 0.6 μm in thickness is formed on a surface of the dielectric layer using a vaporization method, a chemical vapor deposition method (CVD) or the like. Magnesium oxide (MgO) is ideally used to form the protective layer.

This completes the manufacture of the front panel.

1-3-2 Manufacture of Back Panel

On a main surface of a back glass panel made from soda lime glass of approximately 2.6 mm in thickness, address electrodes of approximately 5 μm in thickness are formed by using a screen-printing method to apply, in a stripe pattern, a dielectric material whose main component is Ag. Here, in order for the manufactured PDP to be, for example, a 40-inch class model that complies to NTSC (National Television Standards Committee) or VGA (Video Graphics Array) standards, the gap between two adjacent address electrodes needs to be approximately 0.4 mm or less.

Next, a dielectric film is formed by applying a lead-based glass paste at a thickness of approximately 10 μm to 30 μm across the entire surface of the back panel glass on which the address electrodes were formed, and baking the paste.

The same lead-based material as used in the dielectric film is then used to form barrier ribs of approximately 60 μm to 100 μm in height on the dielectric film, the barrier ribs being positioned in the gap between adjacent address electrodes. The barrier ribs may, for example, be formed by repeatedly screen-printing a paste that includes the above glass material, and then baking the screen-printed paste.

After forming the barrier ribs, red, green and blue phosphor layers are each formed by applying a phosphor ink containing one of red (R) phosphors, green (G) phosphors and blue (B) phosphors, respectively, to the wall surface of the barrier ribs and to the surface of the dielectric film that is exposed between the barrier ribs, and drying/baking the applied phosphor ink.

The following is an example of phosphor materials commonly used in a PDP:

Red Phosphors: $(Y_xGd_{1-x})BO_3:Eu^{3+}$

Green Phosphors: $Zn_2SiO_4:Mn^{3+}$

Blue Phosphors: $BaMgAl_{10}O_{17}:Eu^{3+}$ (or $BaMgAl_{14}O_{23}:Eu^{3+}$)

The phosphor materials may be used, for example, as powders having an average particle size of approximately 3 μm. As for the application method for the phosphor inks, a number of methods are consider possible, although the method used here is a known meniscus method, which involves the phosphor inks being ejected from a fine nozzle so as to form a meniscus (bridge resulting from surface tension). This method is very effective in applying the phosphor inks uniformly to a target area. Moreover, the present invention is, of course, not limited to this method, and other methods, such as a screen-printing method and the like, may be used.

Thus completes the manufacture of the back panel.

Here, the front and back panel glasses are described as being made from a soda lime glass, although this is only exemplary, and other materials may be used.

1-3-3. Completion of PDP

The manufactured front and back panels are fixed together using a sealing glass. A discharge space is then formed by exhausting the space between the sealed panels to create a high vacuum (approx. $1.1\times10^{-4}$ Pa), and filling the vacuum with a discharge gas having an Ne—Xe base, an He—Ne—Xe base, an He—Ne—Xe—Ar base or the like at a predetermined pressure (here, $6.7\times10^{5}$ Pa).

Embodiment 2

Figure 4:
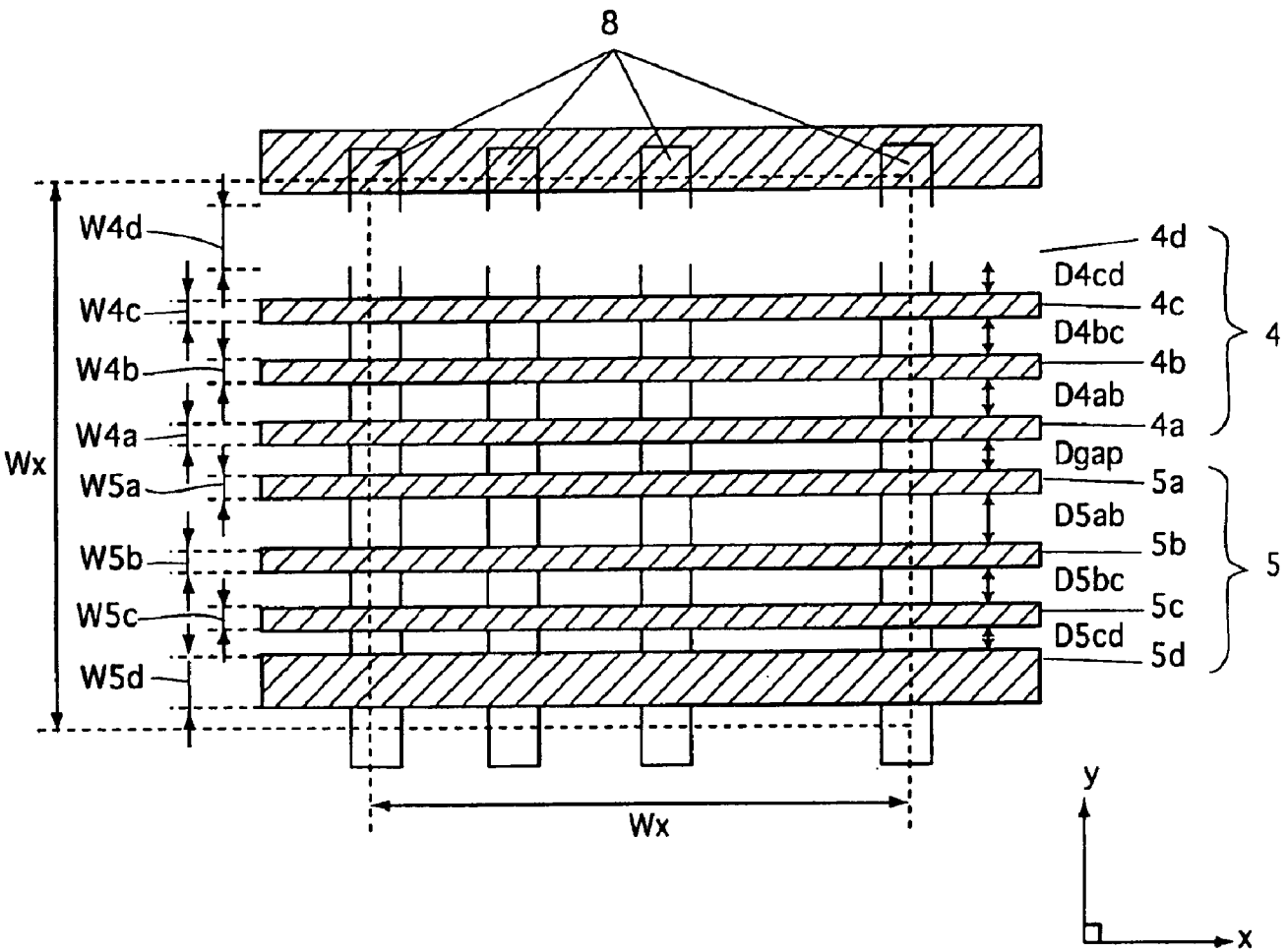
FIG. 4 is a plan view of display electrodes according to an embodiment 2.

FIG. 4 shows display electrode configuration according to an embodiment 2.

Furthermore, Table 2 shows parameter values according embodiment 2.

TABLE 2

| | Symbol | Design Value | Percentage of Pixel Pitch |
|---|---|---|---|
| Pixel Pitch | Wx | 1080 μm | 100.0% |
| Line Part Width | W4a, W5a | 30 μm | 2.8% |
| | W4b, W5b | 40 μm | 3.7% |
| | W4c, W5c | 40 μm | 3.7% |
| | W4d, W5d | 100 μm | 9.3% |
| Line Part Gap | D4ab, D5ab | 80 μm | 7.4% |
| | D4bc, D5bc | 70 μm | 6.5% |
| | D4cd, D5cd | 60 μm | 5.6% |
| Discharge Gap | Dgap | 80 μm | 7.4% |

In embodiment 2, the surface area of each of line parts 4*a*–4*d* and 5*a*–5*d* is different. In embodiment 1, the surface area of line parts 4*a*–4*d*, 5*a*–5*d* are all the same, although as shown in FIG. 4, when the surface area of line parts 4*a* and 5*a* positioned close to the discharge gap is smaller than line parts 4*d* and 5*d* positioned far from the discharge gap, it is possible to, as in embodiment 1, suppress any reduction in the aperture ratio caused by display electrodes 4 and 5, while at the same time achieving further improvements in brightness.

In regard to the resistance value of the electrodes, however, the aggregate width of line parts 4*a*–4*d* and 5*a*–5*d* is preferably 200 μm or greater (20% or greater of cell surface area).

Here, the widths W4*a*–W4*c* and W5*a*–W5*c* of the three respective line parts 4*a*–4*c* and 5*a*–5*c* closest to the discharge gap is 6% or less of cell pitch, which is approximately the same as in embodiment 1, and the widths of line parts 4*d* and 5*d* farthest from the discharge gap is set at around 100 μm in order to reduce the resistance value. As a result, the electrode surface area of line parts 4*a* and 5*a* is relatively small, and this allows for reductions in the discharge current and a lowering of brightness to be achieved.

Furthermore, by enlarging the surface area of line parts 4*d* and 5*d* it is possible to maintain the large overall surface area of display electrodes 4 and 5 while at the same time minimizing the reductions in brightness.

Here, as long as the overall surface area of display electrodes 4, 5 is maintained there are no adverse effects, even if the electrode surface area of line parts 4*a* and 5*a*, for example, is small. However, the precision of electrode forming methods such as a thick or a thin film method is limited to no less than approximately 10 μm (equivalent to appox. 1% of cell pitch when cell pitch in the y direction is 1080 μm)

Embodiment 3

Figure 5:
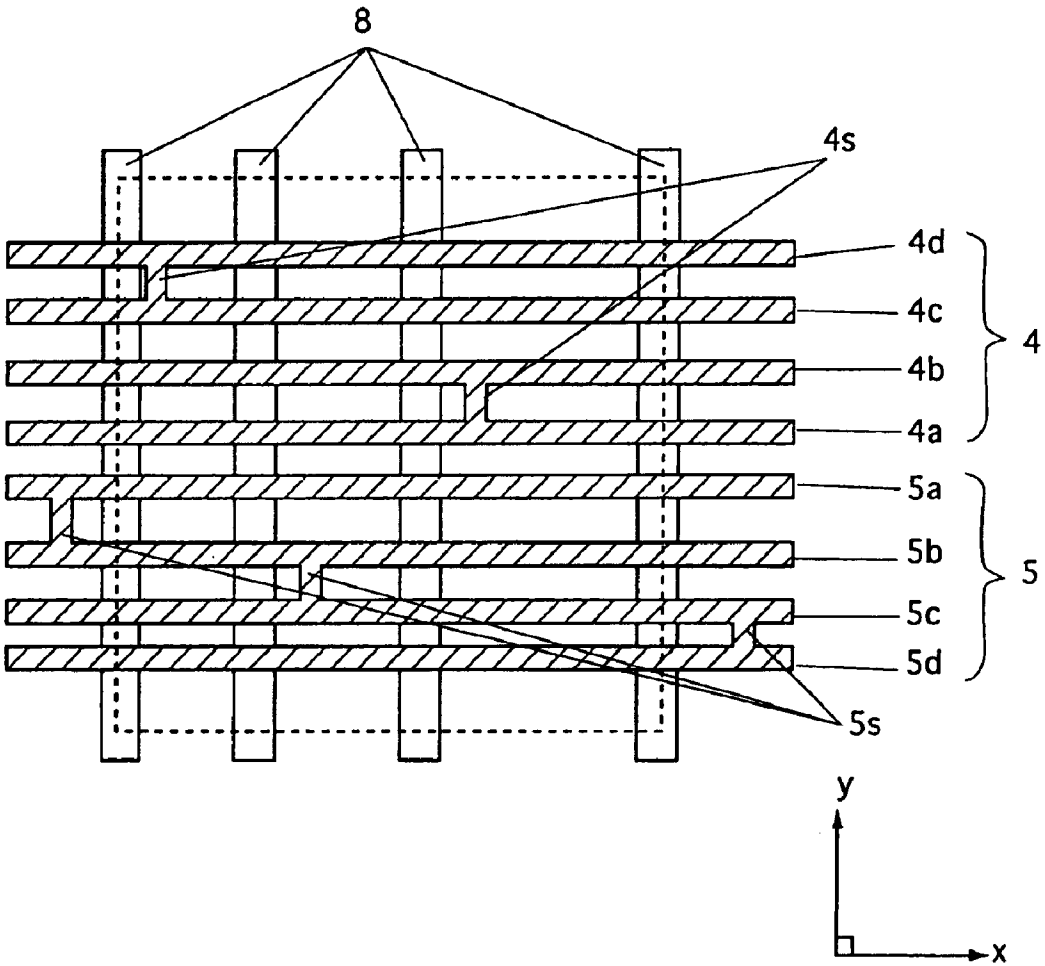
FIG. 5 is a plan view of display electrodes according to an embodiment 3.

FIG. 5 shows a display electrode configuration according to an embodiment 3.

In embodiment 3, connector parts 4*s* and 5*s* that electrically connect each of line parts 4*a*–4*d* and 5*a*–5*d*, respectively, are provided. Specifically, connector parts 4*s* are provided between line parts 4*a* and 4*b*, 4*b* and 4*c*, and 4*c* and 4*d*, and connector parts 5*s* are provided between line parts 5*a* and 5*b*, 5*b* and 5*c*, and 5*c* and 5*d*. Moreover, the connector parts are only disposed in one place between two adjacent barrier ribs 8. The reason for this is as follows.

If connector parts 4*s* and 5*s* were provided to connect line parts 4*a*–4*d* and 5*a*–5*d* between all of the barrier ribs, the aperture ratio of cells would be reduced, and brightness would decline.

Furthermore, to simplify the fixing together of the FP and BP, the cell structure and the positioning of connector parts 4*s* and 5*s* preferably are independent. If the positioning of connector parts 4*s* and 5*s* in a cell is predetermined, the FP and the BP must be matched together precisely, and yield will thus be affected.

Here, to position a connector part anywhere in a cell without causing this problem, the number of connector parts 4*s* and 5*s* in a single cell is limited to no more than one. If only one of each of connector parts 4*s* and 5*s* is disposed in a single cell, reductions in brightness can be kept to approximately 1%, and thus there will be no significant variations in brightness, even if the positioning of the connector parts shifts a little.

Furthermore, the positioning of connector parts 4*s* and 5*s* should be as random as possible. If the periodicity of the placement of the connector parts is greater than the pixel pitch, the pattern formed by the connector parts may be visible on the display surface. Even so, realizing completely random placement is inefficient in terms of mask design, and thus the positioning of connector parts 4*s* and 5*s* in a single cell is limited to no more than one. In this way, even if there is periodicity in the placement of connector parts 4*s* and 5*s*, very few cells will have three or more connector parts 4*s* and 5*s*, and since connector parts 4*s* and 5*s* will not be readily visible through the display surface, a recurring pattern will not be visible.

Here, although the barrier ribs 8 in embodiments 1 to 3 are described as being formed in a stripe pattern so as to be orthogonal to display electrodes 4 and 5, barrier ribs 8 may be configured in other ways.

Figure 30:
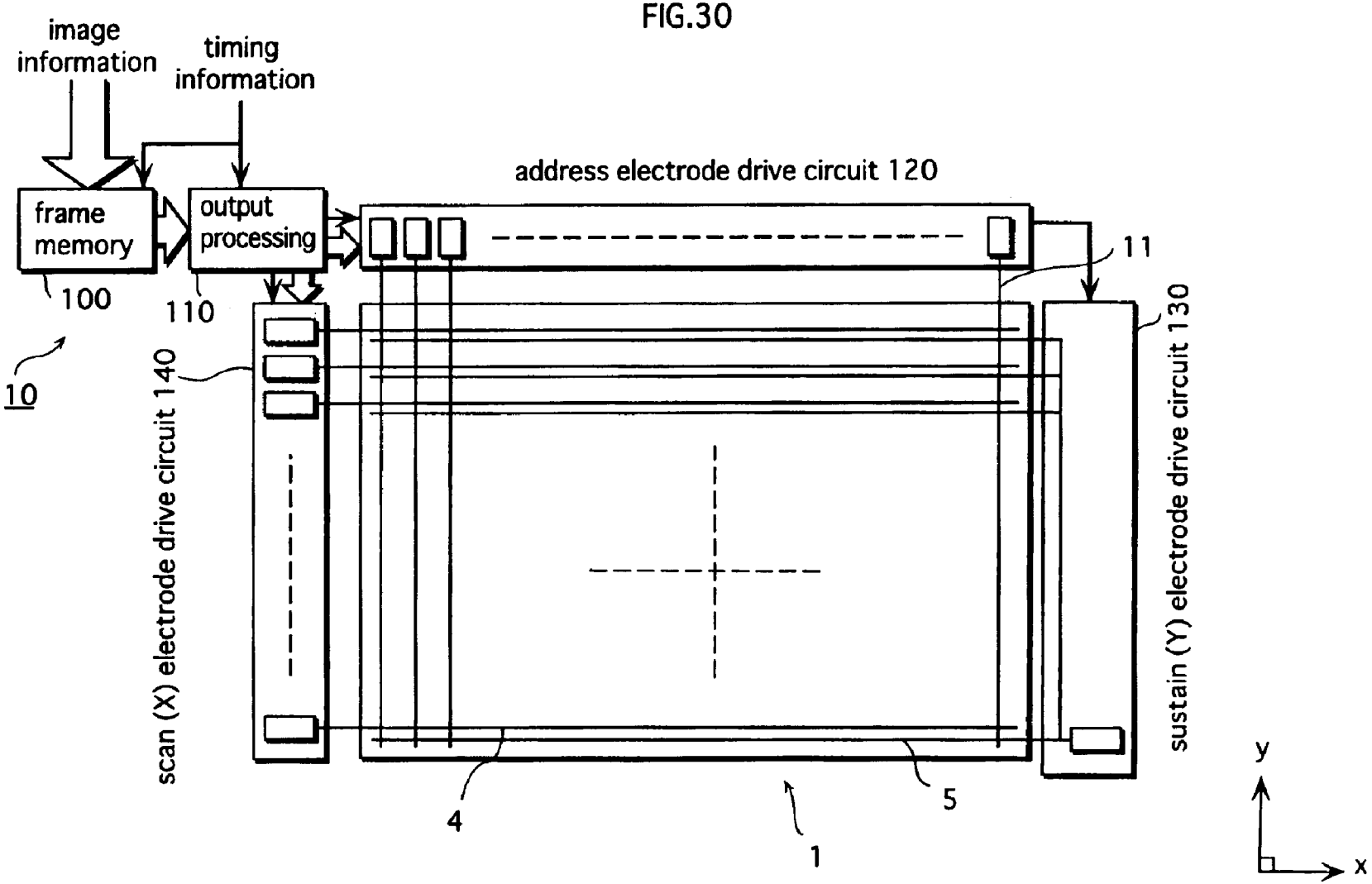
FIG. 30 is a conceptual block view of an image display device that uses a prior art PDP.
Figure 31:
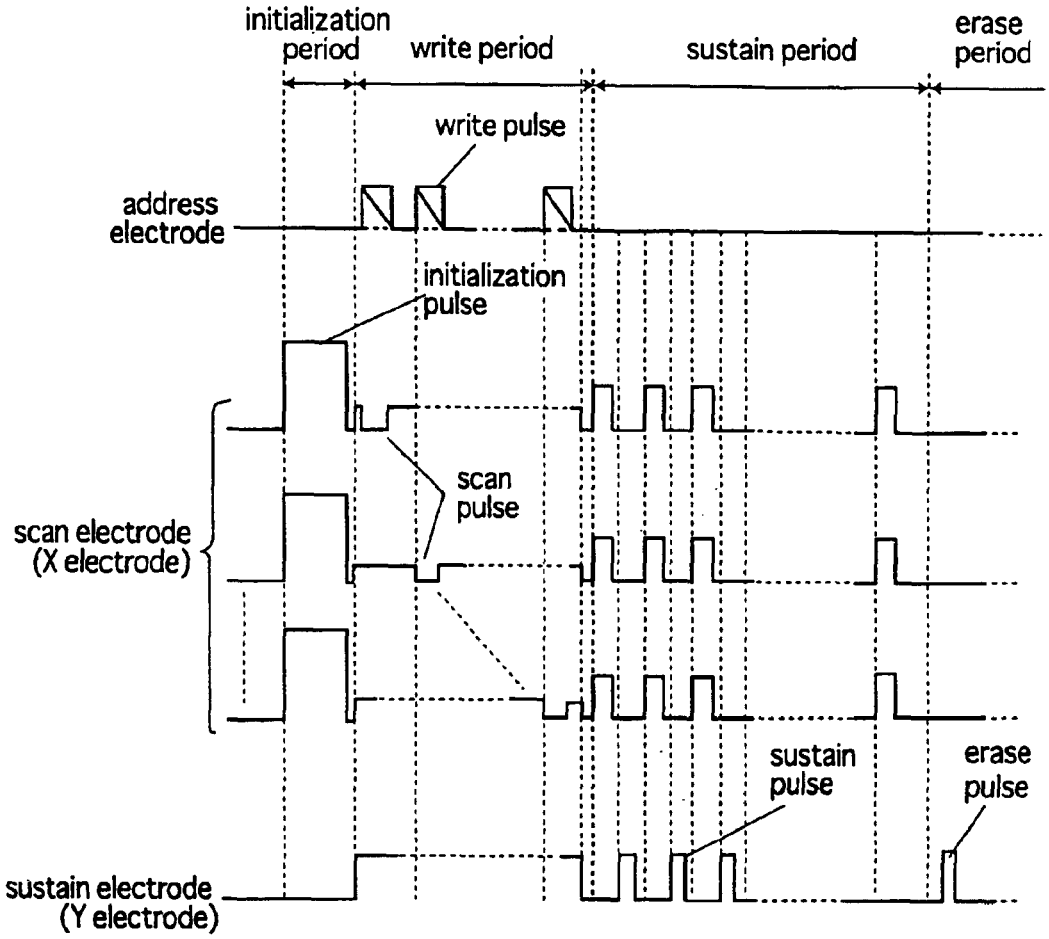
FIG. 31 shows exemplary drive waveforms applied to the electrodes (scan, sustain, and address electrodes) in a PDP.
Figure 32:
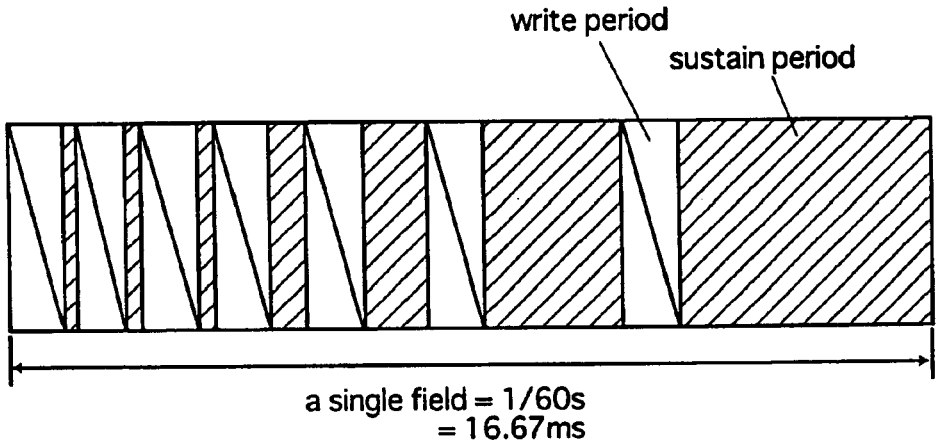
FIG. 32 shows a method for dividing a field into subfields to express 256 gray levels in a prior art AC-type PDP.

Furthermore, it is possible to provide an image display device having high brightness and an excellent image display capacity, if the image display panel is constituted by using a plasma display panel as in embodiments 1 to 3, and by connecting the plasma display panel to (i) a drive circuit for applying a voltage to display electrodes 4 and 5, (ii) a drive circuit for applying a voltage to address electrodes 11, and (iii) a control unit for controlling the drive circuits, as shown in FIG. 30.

Furthermore, the PDP in the above embodiments has a pixel size of 1080 μm×1080 μm, which is the equivalent pixel size of a 42-inch VGA-compatible PDP (approx. 480×852 pixels).

If a pixel size is in this vicinity, the values given in the above embodiments can be used without alteration, although the optimal values will vary in a PDP having a different pixel pitch to that described above. If pixel pitch is reduced, the number of connector parts in a single cell is preferably less than the number of display electrodes (i.e. two), and if pixel pitch is increased, it may be preferable to provided more than four connector parts in a single cell.

Embodiment 4

Figure 6A:
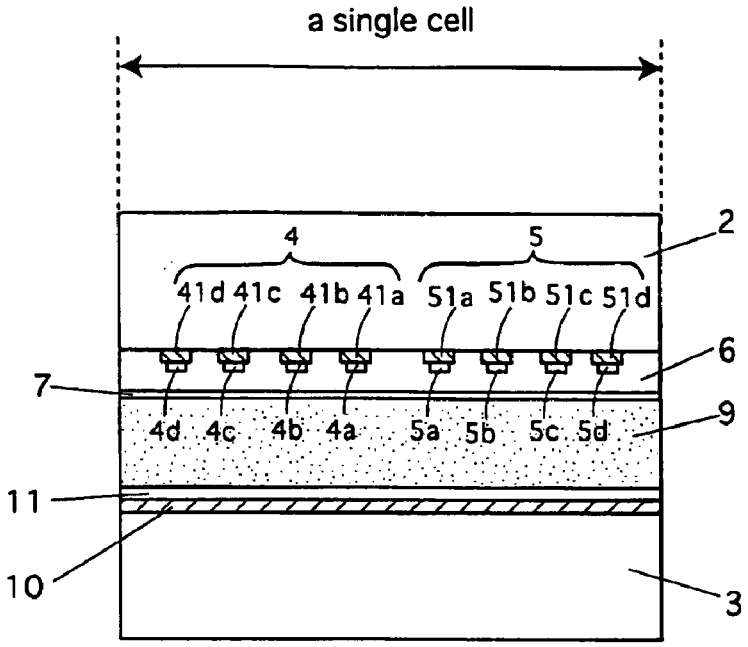
FIGS. 6A, 6B are cross-sectional views of a PDP according to an embodiment 4.
Figure 6B:
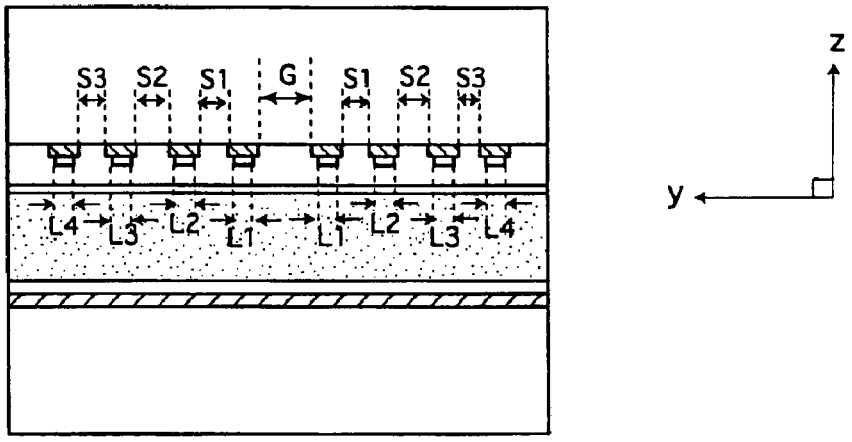

FIGS. 6A and 6B are cross-sectional views in the y direction of a PDP according to an embodiment 4. FIG. 6A shows a positioning of display electrodes, and FIG. 6B shows a size of line parts included in the display electrodes. A feature of embodiment 4 is that black films 41*a*–41*d* and 51*a*–51*d* made from an insulating material are disposed between front panel glass 2 and the line parts 4*a*–4*d* and 5*a*–5*d* of embodiment 1, and the black films 41*a*–41*d* and 51*a*–51*d* are slightly wider than line parts 4*a*–4*d* and 5*a*–5*d*. Furthermore, a black insulating film (so-called "black stripe"; not depicted) is also provided between cells (Ipg) adjacent in the y direction. The black stripe and black films 41*a*–41*d*, 51*a*–51*d* are formed at a good yield rate using similar processes.

Figure 7:
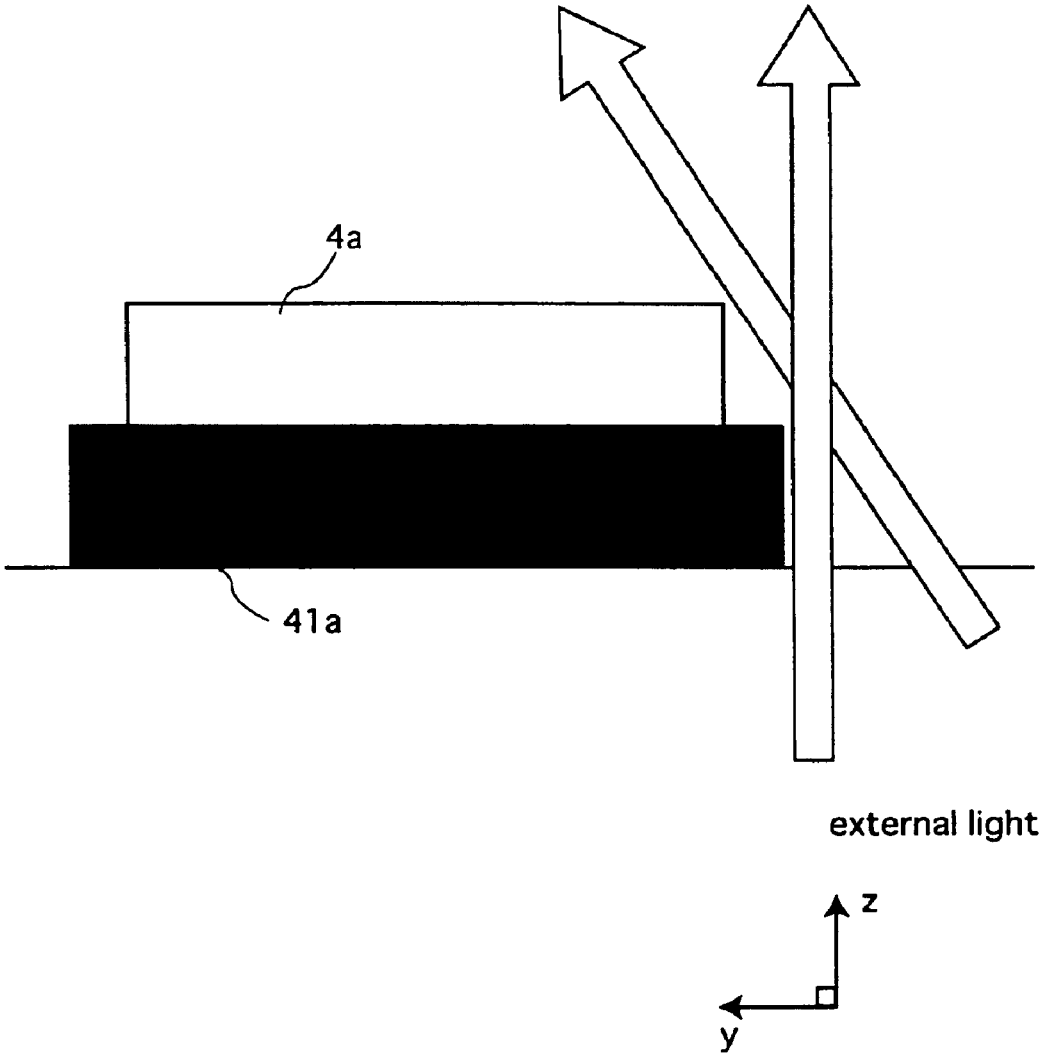
FIG. 7 is a cross-sectional view of the PDP in a vicinity of a line part according to embodiment 4.

In addition to the effects of embodiment 1, this structure allows for excellent visibility to be achieved as a result of the metallic luster of line parts 4*a*–4*d* and 5*a*–5*d*being blocked by black films 41*a*–41*d* and 51*a*–51*d*. Furthermore, as shown in the FIG. 7 cross-sectional view of the PDP in a vicinity of line part 4*a*, black film 41*a* is wider than line part 4*a* according to this embodiment, and thus even when external light strikes the display surface directly from the front (i.e. perpendicular to the display surface) and also from the sides (i.e. at an angle to the display surface), it is possible to prevent the metallic luster of line part 4*a* from reaching the surface of the display screen, and thus to achieve a high level of reflection prevention. In particular, it is possible to prevent metallic luster caused by the lighting in the room of a normal household from reaching the display screen.

Furthermore, because the amount of light striking from the sides is small, the reflected brightness from the narrow surface area sandwiched between the black parts is reduced. Consequently, even if the aggregate black surface area is the same, dividing up the black parts and shaping the sections that reflect external light into thin slits as in embodiment 4, is more effective in reducing the reflected brightness of external light and improving photopic contrast.

Figure 8:
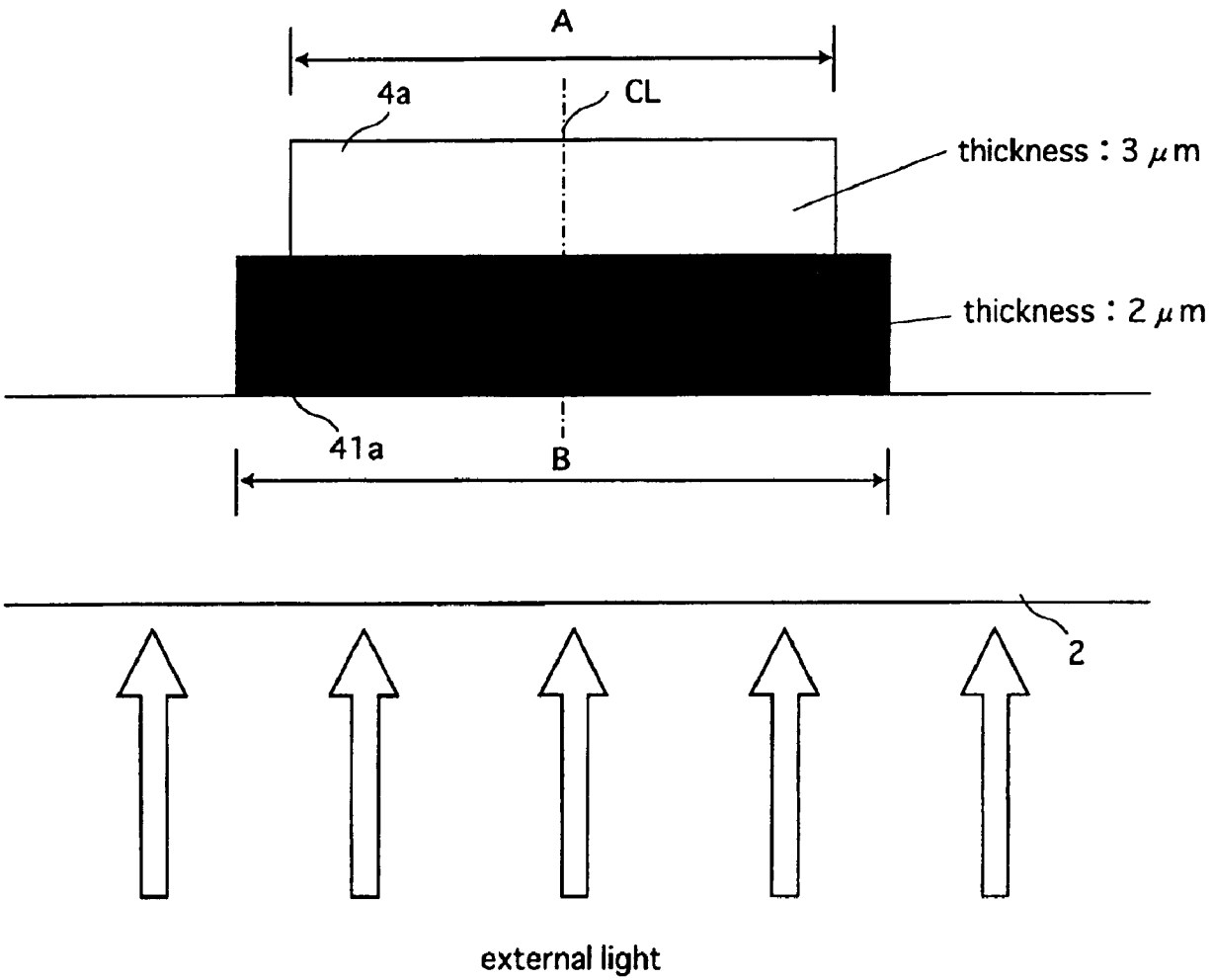
FIG. 8 is a cross-sectional view of the PDP showing a thickness ratio between a line part and a black film.

Furthermore, in relation to the width of the line parts and the black films, investigations were conducted into the change in the reflected brightness of external light when the ratio of line part width A to black film width B was varied with line part 4*a* positioned symmetrically on black film 41*a* with respect to a center line CL, where a thickness of the line part and the black film was 3 μm and 2 μm, respectively, as shown in FIG. 8. The results are shown in FIGS. 9 and 10.

Figure 10:
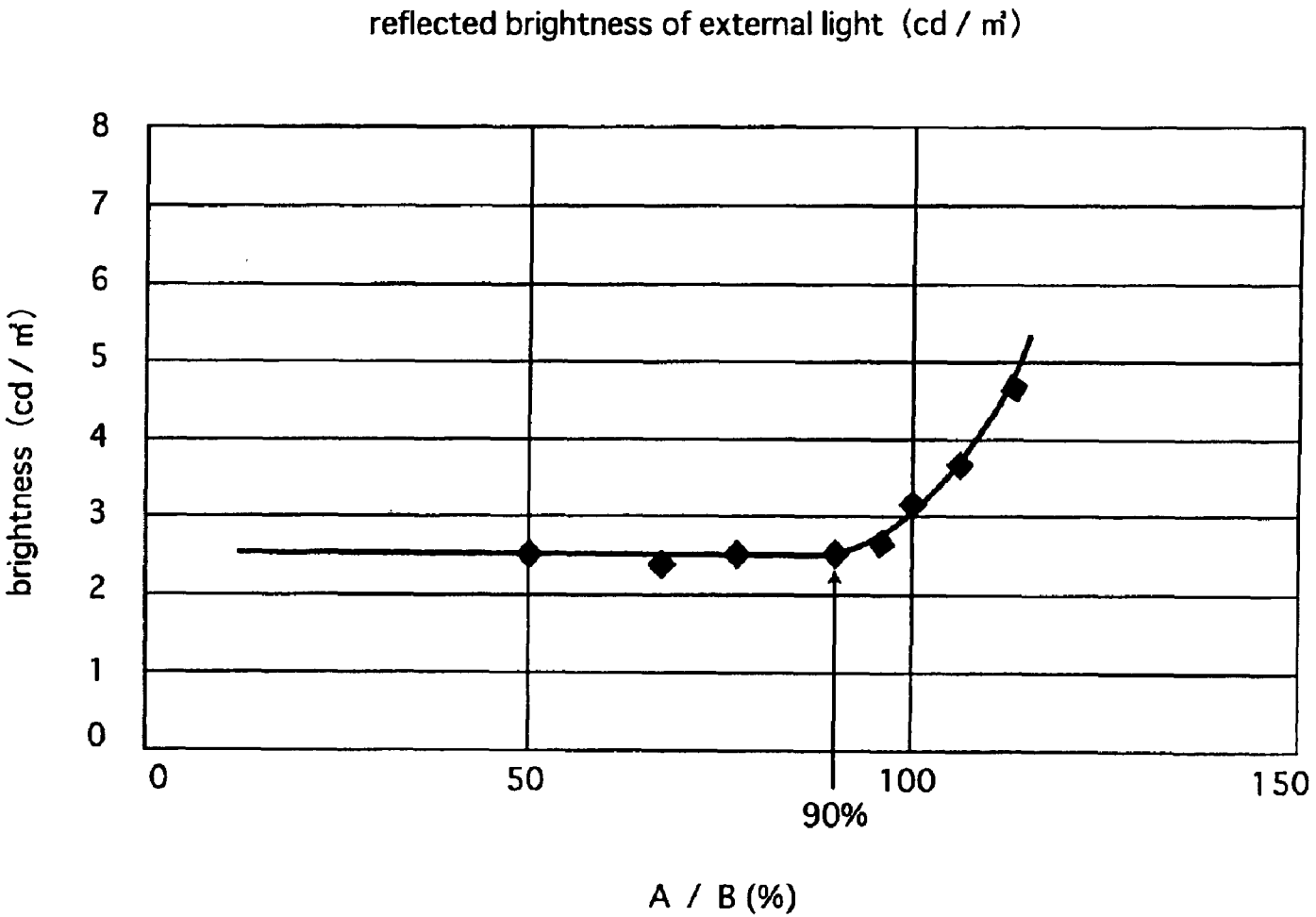
FIG. 10 shows a relationship between the line part/black film thickness ratio and the reflected brightness of external light.

As clearly shown in the graph in FIG. 10, the reflected brightness of external light increases sharply when the ratio A/B exceeds 90%. Consequently, when black films are provided, the ratio A/B is preferably maintained at 90% and below (i.e. based on the measured data results in FIG. 9: reflected brightness of external light=2.5 cd/m$^2$ and below).

Furthermore, the various measurements in a discharge cell according to embodiment 4, as shown in FIG. 6B, is as follows: pixel pitch P=1.08 mm, main discharge gap G=80 μm, line part width L1–L4=40 μm, line part gap S1–S3=70 μm, black stripe width=345 μm. However, the present invention is not limited to these measurements, and the same effects may be obtained within the following ranges: 0.5 mm≦P≦1.4 mm, 60 μm≦G≦140 μm, 10 μm≦L1, L2, L3, L4≦60 μm, L1≦L4≦3L1, 50 μm≦S1, S2, S3≦140 μm.

Here, Table 3 shows the various characteristics of the PDP in embodiment 4. The characteristics of a prior art PDP are given in Table 3 as a comparative example.

TABLE 3

| | Brightness | Dark Contrast | Light Contrast | Misdischarge (Crosstalk) |
|---|---|---|---|---|
| Embodiment 1 | 420 cd/m$^2$ | 1:400 | 1:34 | No |
| Embodiment 4 | 430 cd/m$^2$ | 1:550 | 1:68 | No |
| Prior Art | 350 cd/m$^2$ | 1:300 | 1:25 | No |

In the prior art PDP referred to here, the black films and black stripes provided between the front panel glass and the line parts are formed by separate processes using a photolithography technique.

Furthermore, a filter on the front of the FP is the same as that used in the embodiment 1 panel and the prior art panel (i.e. 90% transparency ratio). Photopic contrast is derived by measuring the brightness ratio during white and black display times at a vertical illumination of 70 Lx and a horizontal illumination of 150 Lx with respect to the display surface of the PDP.

As shown in the above table, the contrast performance of the PDP according to embodiment 4 surpasses that of the comparative example. In the PDP of embodiment 4, black films and a black stripe are manufactured between the line parts and the front panel glass using the same process, and this PDP has a high contrast performance that is equal to or better than that of conventional PDPs, despite the reduction in manufacturing processes.

Manufacture of Display Electrodes in Embodiment 4

Figure 11A:
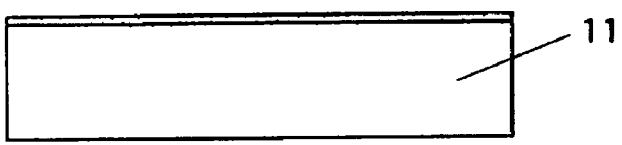
FIGS. 11A–11F show the manufacture of the display electrodes.

Firstly, on the front glass panel is printed and dried a black glass paste (e.g. Dupont's Fodel J4140) formed by adding a photosensitive resin to an organic vehicle (see FIG. 11A). Here, if a black stripe is to be provided, it is printed and dried in the same manner.

Figure 11B:
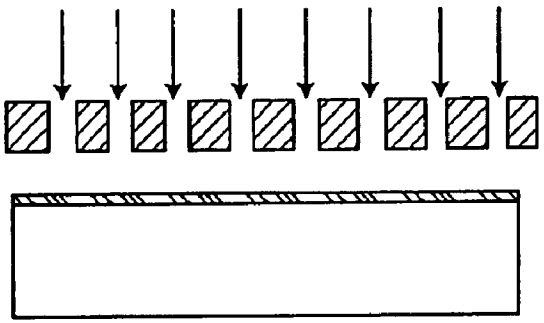
Figure 11C:
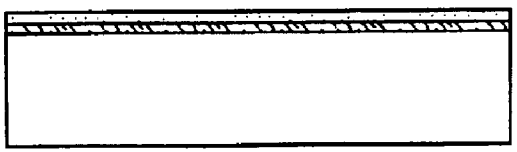

Next, the black film is exposed in a predetermined pattern using a photomask (see FIG. 11B). Then, over the black glass paste is printed and dried, as display electrodes 4 and 5, an Ag paste (e.g. Dupont's Fodel DC231) formed by adding a photosensitive resin to an organic vehicle (see FIG. 11C).

Figure 11D:
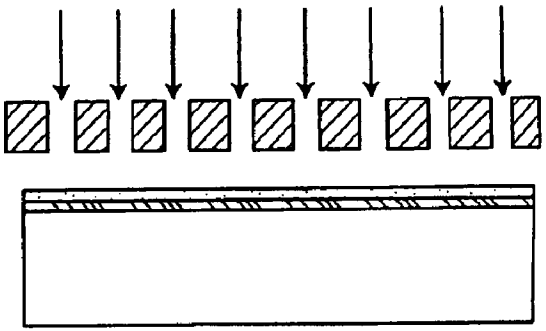
Figure 11E:
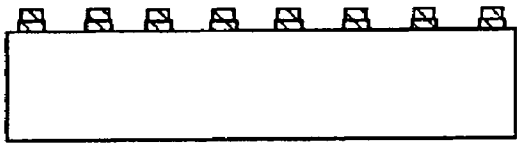
Figure 11F:
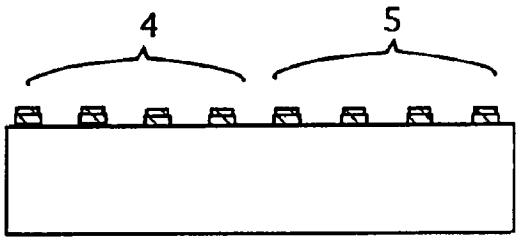

Next, the electrode pattern is exposed using a photomask (see FIG. 11D), and developed together with the black film formed between the electrodes and the front panel glass (see FIG. 11E). The black film, black stripe and display electrodes are completed by baking the above (see FIG. 11F)

Here, although the exemplary display electrode configuration given in embodiment 4 has uniform line part gaps, the line part gaps need not be uniform.

Embodiment 5

Figure 12:
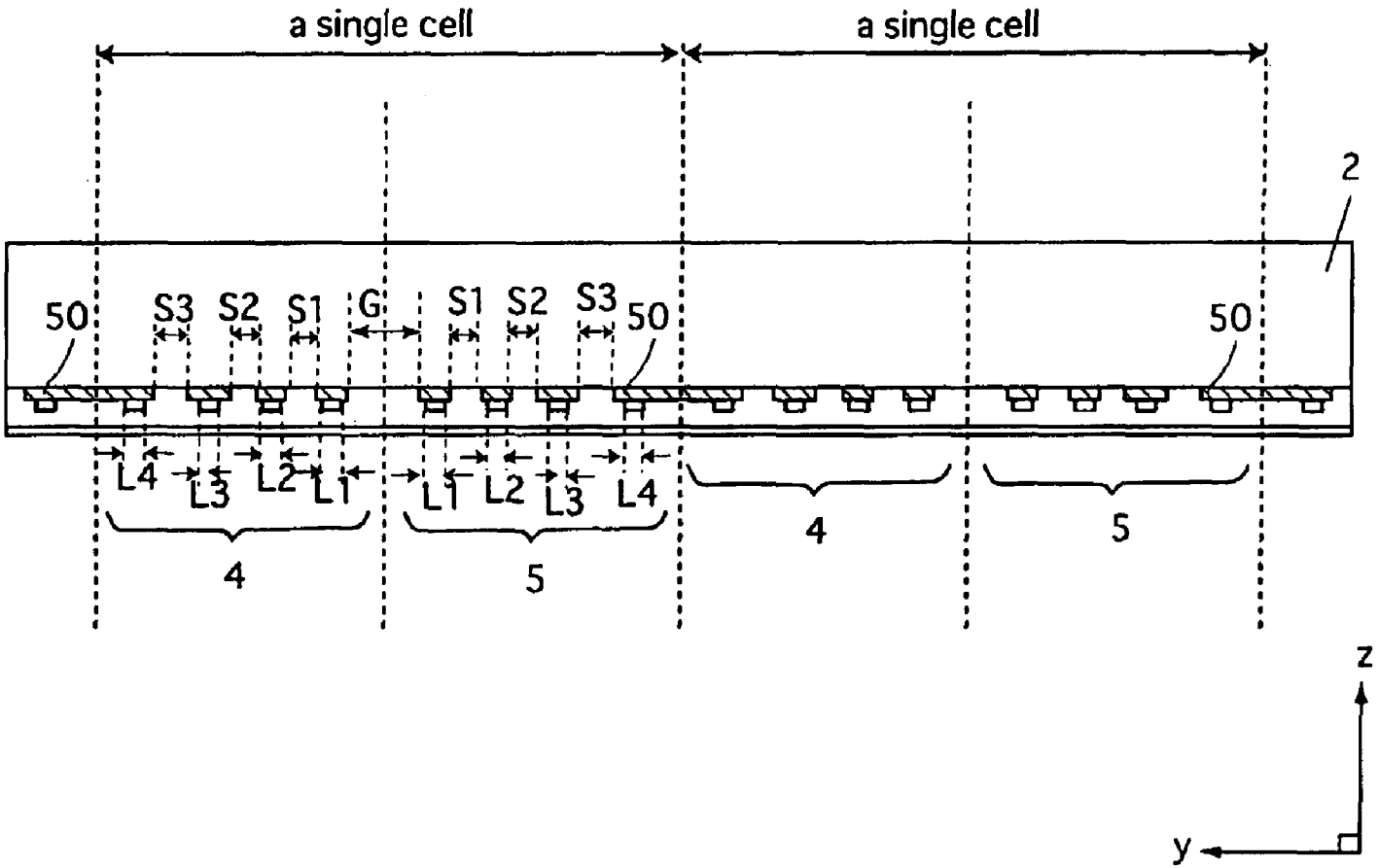
FIG. 12 is a cross-sectional view of a PDP according to an embodiment 5.

FIG. 12 is a cross-sectional view of a PDP showing a display electrode configuration according to an embodiment 5.

A difference with embodiment 4 is that the line part gaps gradually become narrower as the distance from the main discharge gap increases. In addition to allowing the discharge plasma to spread to the outer side of the display electrodes, this configuration allows for the aperture ratio in a central part of the cells to be increased, and for improvements in the retrieval efficiency of visible light.

Furthermore, wide black films 50, which serve as black stripes, are disposed to span from the line parts farthest from the main discharge gap between adjacent cells in the y direction. Over these wide black films 50 are disposed two adjacent line parts.

According to this display electrode configuration, it is possible to provide an even higher contrast PDP in which the blackness ratio of the panel glass surface on which the electrodes are formed increases as the distance from the center of a cell increases.

The detailed measurements of the discharge cells are as follows: pixel pitch P=1.08 mm, main discharge gap G=80 μm, line part width L1, L2=30 μm, line part width L3, L4=40 μm, black film width 41*a*, 51*a*=34 μm, black film width 42*a*, 52*a*=44 μm, line part gap S1=90 μm, S2=70 μm, S3=50 μm, black stripe width=385 μm.

Figure 13:
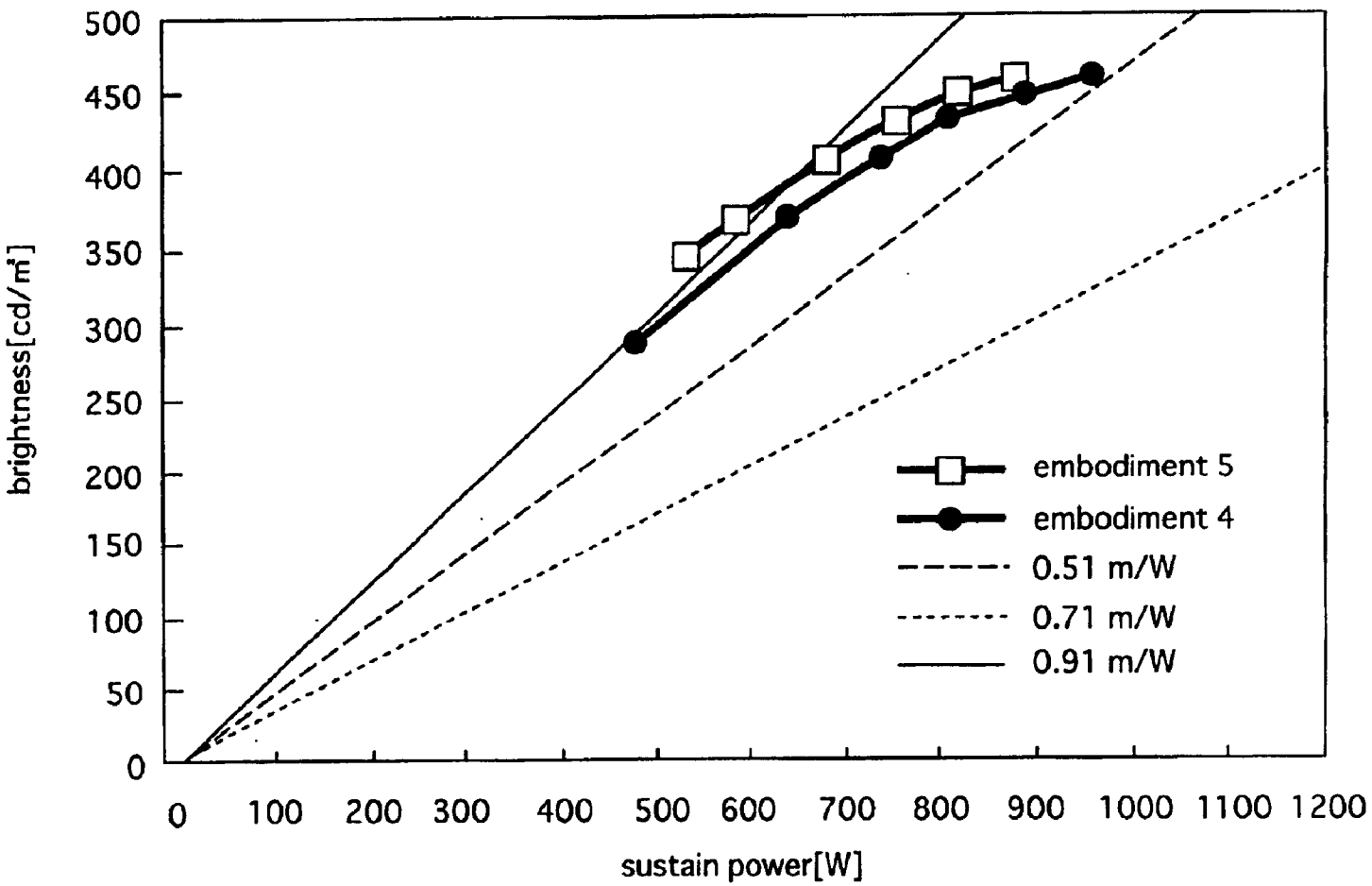
FIG. 13 shows power-brightness curves for the PDPs according to embodiments 4 and 5.

FIG. 13 shows power-brightness curves for the PDPs according to embodiments 4 and 5. Generally, brightness can be increased in a PDP by increasing the power input to the panel, although because power-brightness curves tend towards saturation, luminescence efficiency tends to be reduced by power input increases. Thus, although power input and also brightness is increased by increasing the applied voltage (sustain voltage) in the sustain period, luminescence efficiency declines.

Even in the power-brightness curves in FIG. 13, the general tendency towards saturation can be seen despite brightness gradually increasing as a result of increasing the panel power input by increasing the sustain voltage. However, in comparison to the embodiment 4 structure, the embodiment 5 structure realizes brightness which is greater than or equal to that of embodiment 4, despite equal reductions in power by the sustain voltage, and at the high voltage end, brightness is approximately 10% higher in comparison to the embodiment 4 structure. In other words, the embodiment 5 structure has good efficiency characteristics in comparison to the embodiment 4 structure.

Here, Table 3 describes the various characteristics of the PDP according to embodiment 5.

The embodiment 5 panel has a transparency ratio of 90% in comparison to the 85% transparency ratio of both the embodiment 4 panel and the prior art panel. This is because of being able to increase the blackness ratio and the contrast ratio, and consequently the transparency ratio of the FP, by having a display electrode configuration in which the width of the line parts is narrow in a central part of the cells and widens as the distance to an adjacent cell decreases.

Generally, the reflectivity of external light in a PDP is greater on the panel display side because of the phosphor layers, rib walls and the like appearing to be white in color, and the photopic contrast ratio is in a range of approximately 20:1 to 50:1. However, in embodiment 5, it is possible to increase the blackness ratio without reducing the aperture ratio in a central part of the cells, and thus improve the photopic contrast as well as obtaining sufficient brightness, by relatively narrowing the line part widths in a vicinity of the main discharge gap and increasing the line part widths farther from the main discharge gap, and also by disposing wide black films 50, which serve as black stripes, between adjacent cells. Moreover, as mention in embodiment 4, amelioration of the photopic contrast can be achieved by dividing up the black sections and providing the sections that look white in a stripe pattern. More specifically, this allows for an extremely high photopic contrast ratio of approximately 70:1 to be realized.

As is clear from the above, a PDP employing the display electrode configuration according to embodiment 5 is able to realize high brightness and excellent contrast, even when the panel power input is reduced below the prior art.

Here, in embodiment 5, the same effects maybe obtained, even within the following ranges: 0.5 mm≦=P≦1.4 mm, 60 μm≦G≦140 μm, 10 μm≦L1, L2≦60 μm, 20 μm≦L3, L4≦70 μm, 50 μm≦S1≦150 μm, 40 μm≦S1≦140 μm, 30 μm≦S1≦130 μm.

Furthermore, although in embodiment 5 the electrode configuration is such that the line part gaps gradually decrease as the distance from the main discharge gap increases, the present invention is not limited to this configuration.

Embodiment 6

Figure 14:
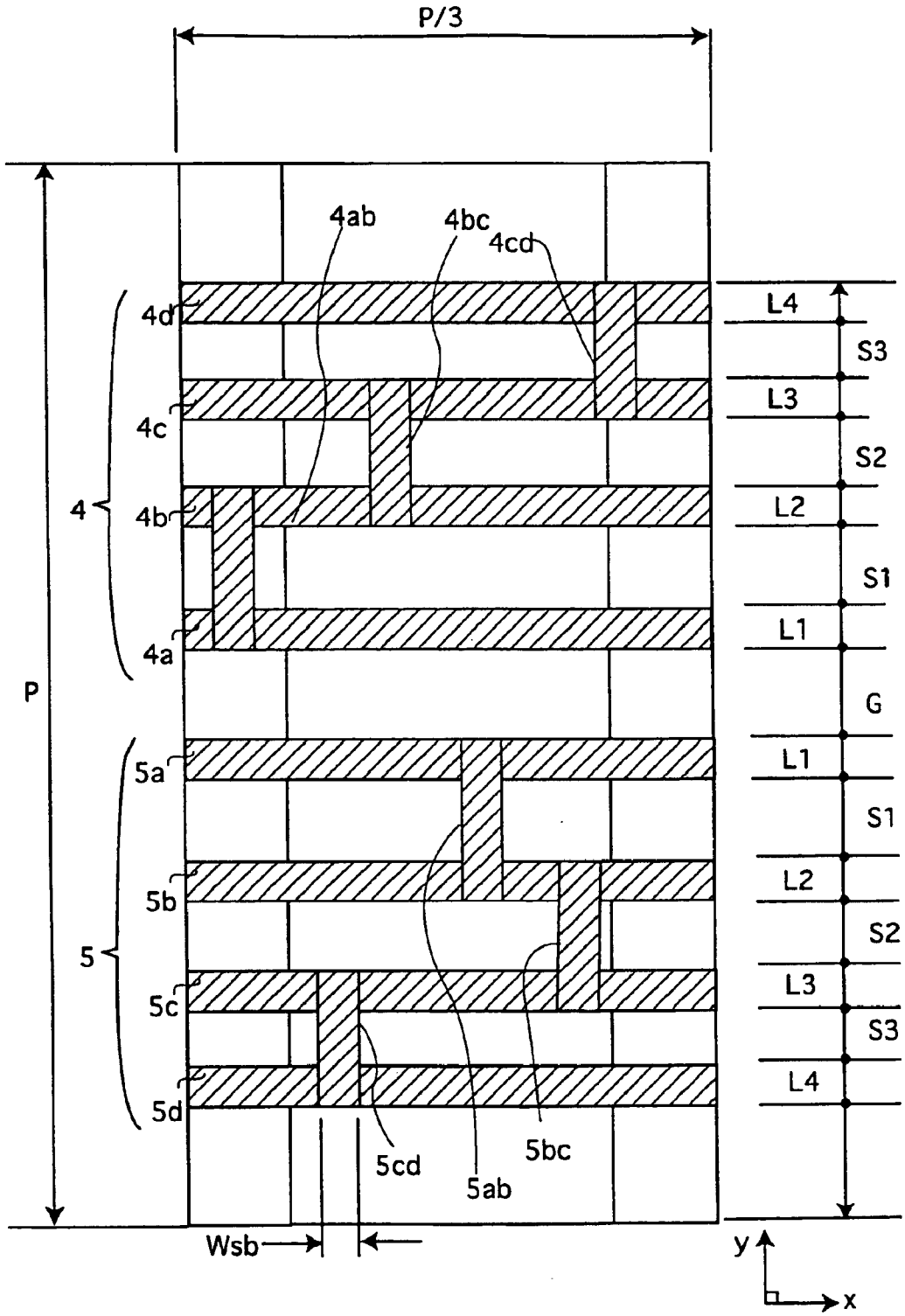
FIG. 14 is a plan view of display electrodes according to an embodiment 6.

FIG. 14 shows a display electrode pattern according to an embodiment 6. A difference with embodiments 4 and 5 is that connector parts (in this case, "short bars") 4*ab*, 4*bc*, 4*cd*, 5*ab*, 5*bc*, 5*cd* are disposed randomly so as to respectively connect line parts 4*a*, 4*b*, 4*c*, 4*d*, 5*a*, 5*a*, 5*b*, 5*c*, 5*d*. Black films are formed also between front panel glass 2 and these connector parts 4*ab*, 4*bc*, 4*cd*, 5*ab*, 5*bc*, 5*cd*. An example of the various measurements in the display cells is as follows: pixel pitch P=1.08 mm, main discharge gap G=80 μm, black film width=44 μm, line part width L1–L4=40 μm, line part gap S1=90 μm, S2=70 μm, S3=50 μm, width of black film serving as black stripe between adjacent cells in the y direction=345 μm, short bar width Wsb=40 μm.

Table 4 shows, according to embodiment 6, the provision/non-provision of short bars, short bar intervals, disconnection probabilities (no. of times/line), line resistance values, and disconnection repair probabilities.

TABLE 4

| Sample No. | 1 | 2 | 3 |
|---|---|---|---|
| Short bars | No | Yes | Yes |
| Short bar Intervals (cm) | — | 8 | Random |
| Disconnection Prob. | 0.15 | 0.004 | 0.002 |
| Line Resistance Values (Ω) | 67 | 53 | 47 |
| Disconnect Repair Prob. | No | Maybe | Yes |

As shown in this table, the provision of short bars between the line parts results in a reduction in the disconnection probability from 15% to 0.4% in comparison to when short bars are not provided, and is thus extremely effective. However, when the interval between short bars has a regular periodicity, moire occurs on the display surface, and image quality is drastically reduced, this being a major problem. Here, in embodiment 6, it is possible to suppress the occurrence of moire and furthermore reduce the disconnection probability by providing the short bars randomly between the line parts. This allows for PDPs to be realized that are low cost, have excellent display performance capabilities, and with respect to which yield reductions resulting from faulty connections that conventionally occur during electrode formation are greatly ameliorated.

As is clear from the above, it is possible to realize excellent PDPs having high contrast and image quality, no moire, and with respect to which yield reductions resulting from faulty connections during the electrode formation are greatly ameliorated, by using line parts and short bars in the display electrodes, and by disposing black films between the display electrodes and the front panel glass in a PDP according to embodiment 6.

Here, in embodiment 6 the same effects may be obtained within the following ranges: 0.5 mm≦P≦1.4 mm, 60 μm≦G≦140 μm, 10 μm≦L1, L2≦60 μm, 20 μm≦L3≦70 μm, 20 μm≦L4≦{0.3P−(L1+L2+L3)}μm, 50 μm≦S1≦150 μm, 40 μm≦S2≦140 μm, 30 μm≦S3≦130 μm, 10 μm≦Wsb≦80 μm, Ln+10 μm≦LBn≦Ln+10 μm (where n=1–4).

Furthermore, although in embodiment 6 the line part gaps gradually narrow as the distance from the main discharge gap increases, the present invention is not limited to this arrangement of the gaps.

Embodiment 7

Figure 15:
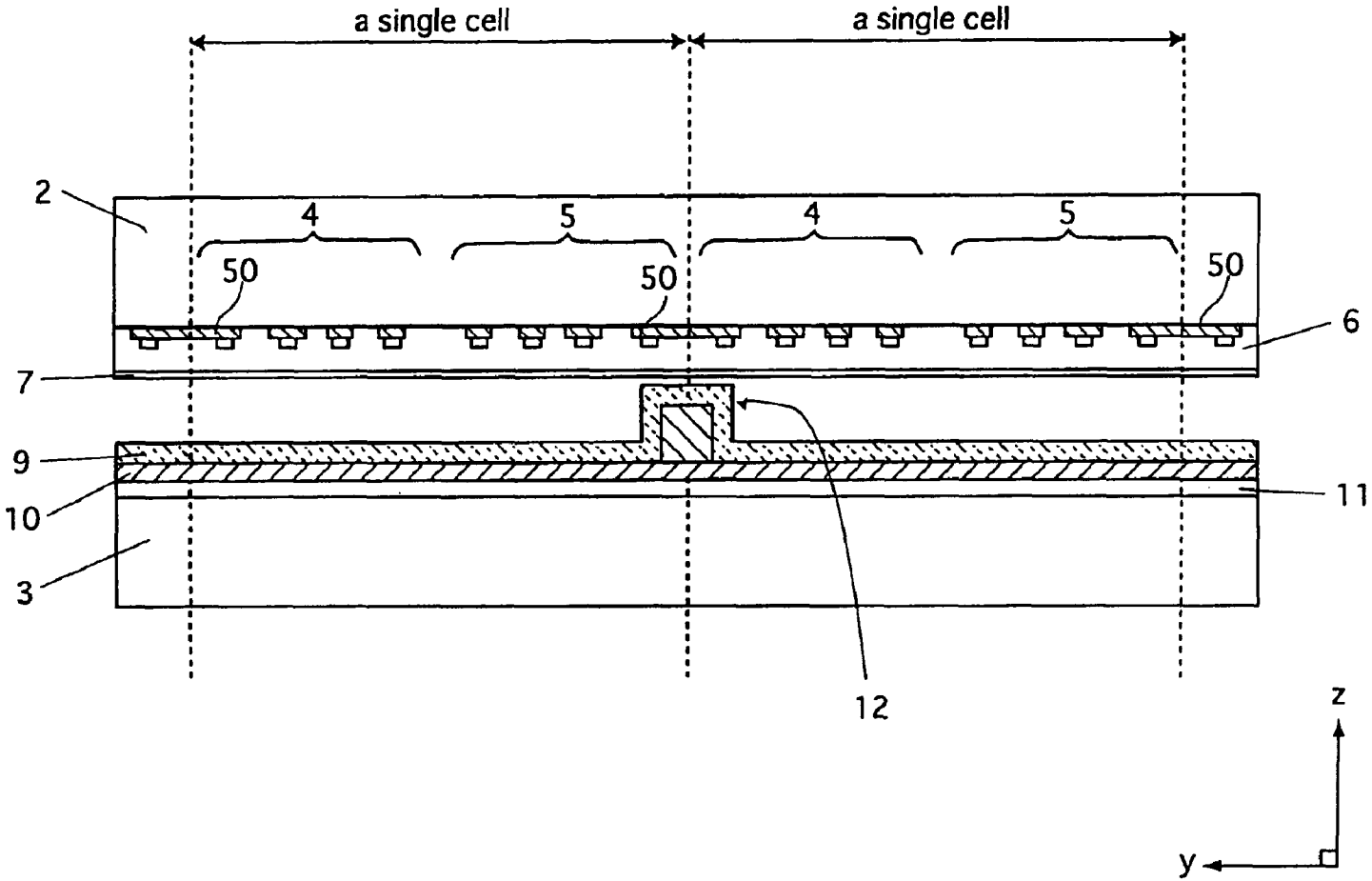
FIG. 15 is a cross-sectional view of a PDP according to an embodiment 7.

FIG. 15 is a schematic view of a discharge cell structure according to an embodiment 7. Although substantially the same to that of embodiment 6, the display electrode configuration according to embodiment 7 is characterized in that second barrier ribs 12 (auxiliary ribs) are provided between adjacent cells in the discharge space. These auxiliary ribs 12 are lower in height than barrier ribs 8.

An example of the various measurements in the discharge cells is as follows: pixel pitch P=1.08 mm, main discharge gap G=80 μm, line part width=40 μm, line part gap S1=90 μm, S2=70 μm, S3=50 μm, width of black film serving as black stripe between adjacent cells=385 cm, short bar width=40 μm, barrier rib 8 hieght=110 μm, auxiliary rib height=60 μm, auxiliary rib top width=60 μm, auxiliary rib bottom width=100 μm.

Table 5 shows the distance Ipg between adjacent cells, the provision/non-provision of auxiliary ribs, and the occurrence/non-occurrence of misdischarge due to crosstalk.

TABLE 5

| Ipg (μm) | 60 | 120 | 260 | 260 | 300 | 300 | 360 | 360 |
|---|---|---|---|---|---|---|---|---|
| Auxiliary Rib | Yes | Yes | No | Yes | No | Yes | No | Yes |
| Crosstalk · Misdischarge | Yes | No | Yes | No | Yes | No | No | No |

As is clear from this table, when there are no auxiliary ribs and the adjacent cell gap Ipg is approximately 300 μm or less, misdischarge caused by crosstalk occurs, and graininess and dispersion occurs in the middle tones. On the other hand, when auxiliary ribs are provided as in embodiment 7, misdischarge from crosstalk and the like does not occurs, even at adjacent cell gaps Ipg approaching 120 μm, and excellent image display performance capabilities are achieved. This is because of being able to suppress the dispersion of priming particles (i.e. charge particles and the like generated by discharge plasma) from the periphery of a discharge cell to an adjacent cell.

Here, while the suppression of crosstalk is increased by increasing the height of auxiliary ribs 12, this reduces the conductance in the panel, and the possibility thus arises that when the panel is evacuated at a high temperature in the panel sealing/evacuation processes of manufacturing prior to being filled with a discharge gas, achievable vacuum levels may be reduced and the filling of the discharge gas may take place with residual gases such as H2O and CO2 remaining in the panel. Since this may cause misdischarge and fluctuations in the operation when the panel is driven, auxiliary ribs 12 are preferably lower in height than barrier ribs 8.

As an aside, investigations into increasing the auxiliary rib top width facing the FP revealed the possibility of limiting the area in which discharge plasma is generated within a discharge cell, and consequently it is possible to control the power input to the panel independently of the display electrode configuration. Thus, by widening the top width of auxiliary ribs 12 to approximately 180 μm, relative efficiency is raised due to the suppression of power applied in the sustain discharge, and excellent display performance capabilities can be obtained without crosstalk occurring, even when the adjacent cell gap Ipg is narrowed to approximately 60 μm. In particular, luminescence efficiency is improved because the provision of auxiliary ribs 12 in a lower part of the electrodes allows for the cutting of discharge plasma that does not contribute to brightness due to being blocked by the electrodes.

As is clear from the above, by employing auxiliary ribs 12 that are lower in height than barrier ribs 8, the PDP according to embodiment 7 makes it possible to suppress the panel power input independently of the display electrode configuration, and can markedly suppress misdischarge, such as crosstalk, between adjacent cells. As a result, it is possible to realize a PDP that achieves high contrast (high image quality) and low power consumption, and in which the line parts formed on black films can each be controlled independently.

Here, in embodiment 7 the same effects may be obtained within the following ranges: 0.5 mm≦P≦1.4 mm, 60 μm≦G≦140 μm, 10 μm≦L1, L2≦60 μm, 20 μm≦L3≦70 μm, 20 μm≦L4≦{0.3P−(L1+L2+L3)}μm, 50 μm≦S1≦150 μm, 40 μm≦S2≦140 μm, 30 μm≦S3≦130 μm, 10 μm≦short bar width≦80 μm, 50 μm≦auxiliary rib top width≦450 μm, 60 μm≦auxiliary rib height≦barrier rib height−10 μm.

Furthermore, although thick film Ag electrodes are used as the display electrodes in the above embodiment, the present invention is not limited to this structure, and similar effects can be obtained, even when employing thick film metallic electrodes formed by using a printing method to pattern a thick film paste made by dispersing a metallic power such as Ag/Pd, Cu or Ni in an organic vehicle, and firing the patterned thick film paste. Moreover, Cr/Cu/Cr, Au, Ag/Pd, Al, tin oxide, indium oxide, and the like may also be used.

Furthermore, although a glass paste that includes a black pigment is used as the black film, the present invention is not limited to this structure. Moreover, it is possible to employ a black film that is formed by using an etching method, a lift-off method, or the like to pattern an insulative thin-film oxide such has chromium oxide.

Embodiment 8

Figure 16:
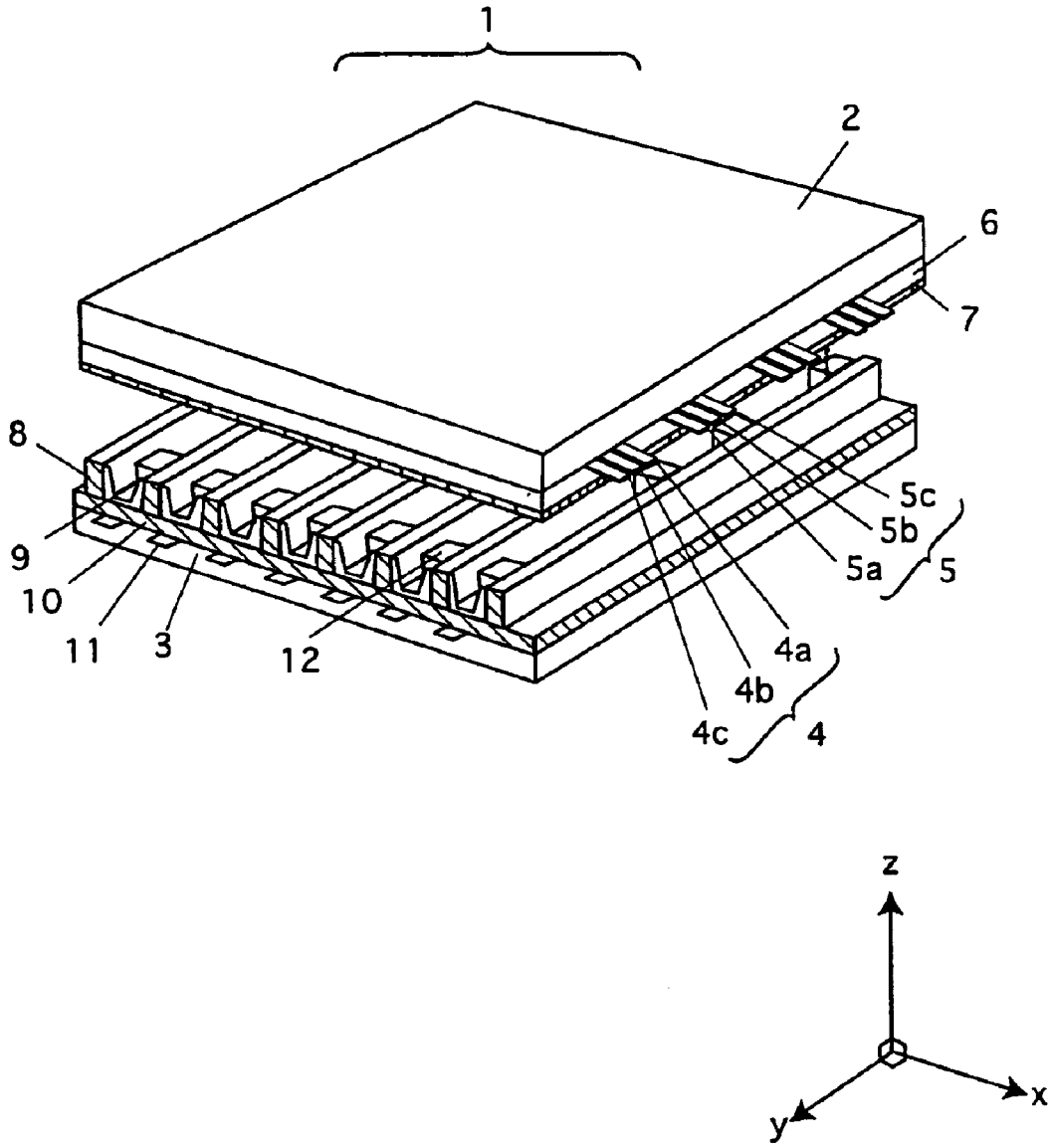
FIG. 16 is a perspective view of a PDP according to an embodiment 8.
Figure 17:
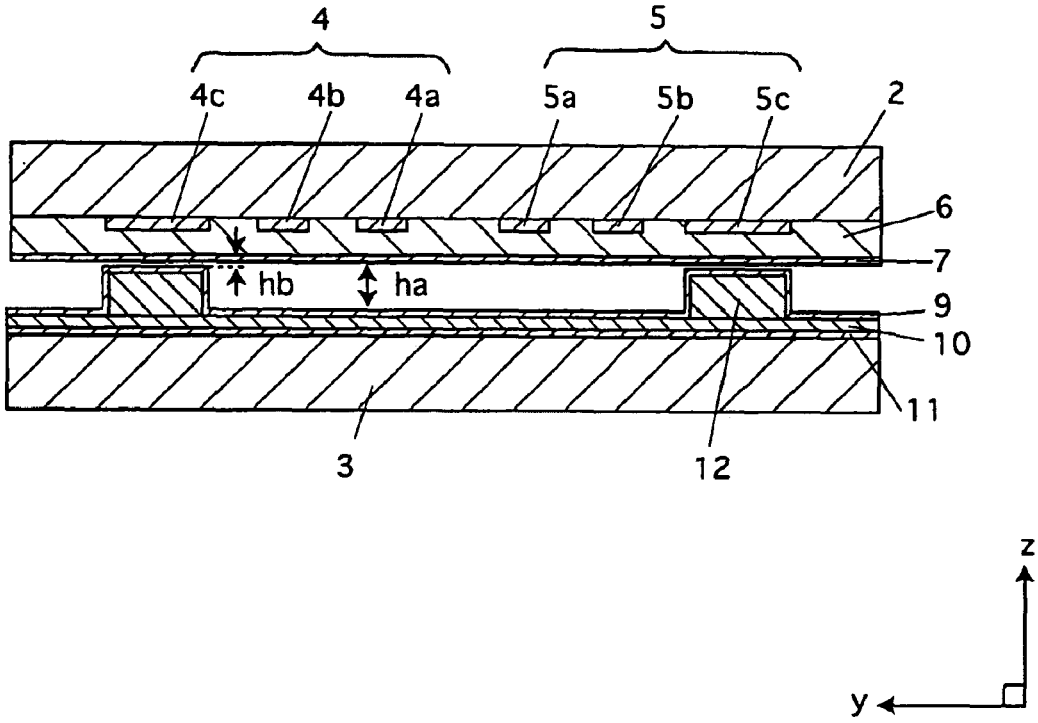
FIG. 17 is a cross-sectional view of the PDP according to embodiment 8.
Figure 18A:
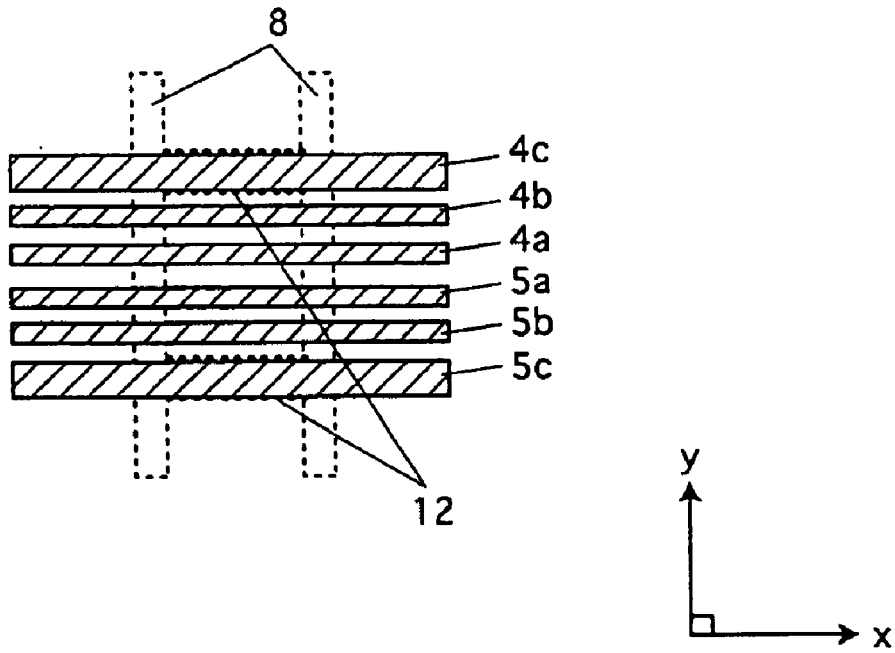
FIG. 18 is a plan view of display electrodes according to embodiment 8.
Figure 18B:
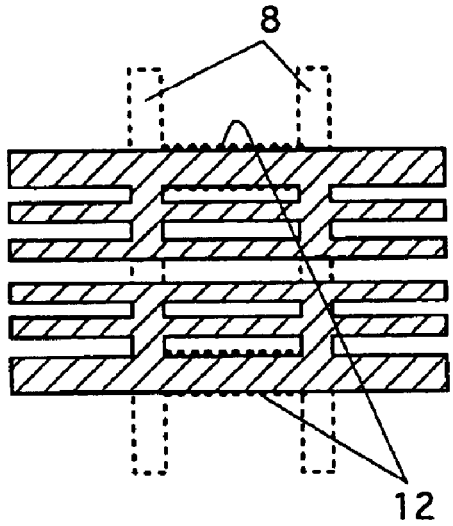

FIG. 16 shows a perspective view of a PDP according to an embodiment 8, FIG. 17 shows a cross-sectional view of the PDP from the x direction, and FIG. 18 shows a display electrode configuration from the FP side.

In embodiment 8, display electrodes 4 and 5 are each structured from three line parts. Line parts 4*c* and 5*c* positioned farthest from the main discharge gap are set to be wide, and auxiliary ribs 12 are included so to overlap with line parts 4*c* and 5*c*. (As in FIG. 17, auxiliary ribs 12 are disposed directly below and extend along the z direction of line parts 4*c* and 5*c*. Auxiliary ribs 12 in other cells are disposed according to the same positional relationship) A height hb of the discharge space facing line parts 4*c* and 5*c* is lower than a height ha of the discharge space in other areas.

There are prior art panels that constitute display electrodes 4 and 5 from a transparent electrode and a metallic base line. This is to secure the discharge magnitude and increase brightness, by widening the electrode surface area without widening the main discharge gap where the discharge initiates.

Approaches that have been adopted in the prior art include providing an opening in the display electrodes (transparent electrodes), and partitioning each electrode into a plurality of parts (providing line parts). These approaches have the effect of reducing current, and furthermore by employing only metallic electrodes (i.e. no transparent electrodes), the number of manufacturing processes can be reduced in addition to suppressing any increase in resistance.

However, while it is possible to reduce the discharge current by making the entire electrode surface area as small as possible when auxiliary ribs 12 are not provided, brightness declines because of the overall reduction in power supplied in the discharge space.

In contrast, by forming auxiliary ribs 12 in an orthogonal direction to barrier ribs 8, as in embodiment 8, it is possible to selectively reduce the discharge current flowing to the discharge space facing line parts 4*c* and 5*c*, even when entire electrode surface area is large.

Because line parts 4*c* and 5*c*, positioned farthest from the main discharge gap in display electrodes 4 and 5, correspond to the edge of the electrodes, they do not affect the supply of discharge current. However, discharge luminescence (does not affect brightness as much as the supply current amount) generated in the discharge space facing line parts 4*c* and 5*c* is mostly blocked by line parts 4*c* and 5*c*. Thus, it is considered that brightness will not be greatly affected, even if the discharge is limited in relation to line parts 4*c* and 5*c*.

The above is particularly notable when display electrodes 4 and 5 are constituted by a plurality of partitioned line parts. In other words, since excess current collects in line parts 4*c* and 5*c*, substantial effects can be gained by seeking to reduce power to this area.

Because, however, the discharge area is narrowed and brightness is reduced due to the discharge not expanding as far as line parts 4*c* and 5*c*, auxiliary ribs 12 need to be formed so as allow a sufficient electric field to be generated by line parts 4*c* and 5*c*.

Figure 19:
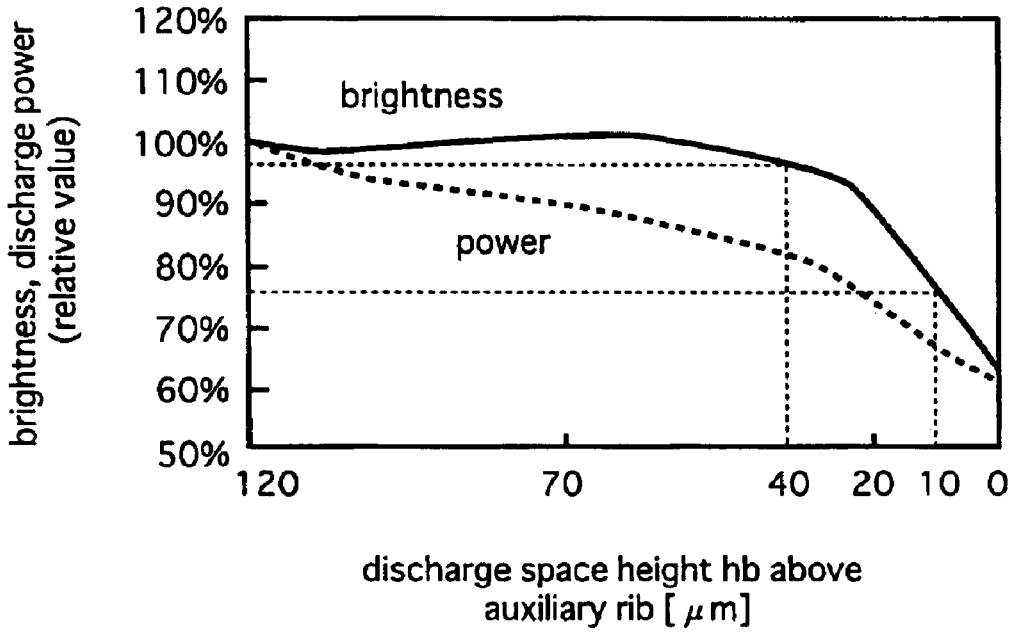
FIG. 19 shows a relationship between power and brightness in a vicinity of an auxiliary rib according to embodiment 8.

FIG. 19 shows a relationship between discharge power, brightness and the height hb of the discharge space above auxiliary ribs 12 that faces line parts 4*c* and 5*c*. In this case, because the discharge space height hb is realized by the difference between the height of barrier ribs 8 and auxiliary ribs 12, hb=0 corresponds to when the height of barrier ribs 8 and auxiliary ribs 12 is the same, and hb=ha (120 μm in the given example) corresponds to when auxiliary ribs 12 are not provided.

Accordingly, corresponding power reductions can be gained if the discharge space height hb is even a little lower than the height ha (presuming that auxiliary ribs 12 are provided), and in particular, power reductions of 5% or more can be gained when hb<ha−20 μm. However, if the height hb is too low, brightness declines markedly. This is because of a reduction in the range of the electric field distribution that line parts 4*c* and 5*c* form in the discharge space.

Consequently, by setting the height hb at 10 μm or greater, the reduction in brightness is 30% or less, and even more preferably, by setting the height hb at 40 μm or less, it is possible to achieve reductions in brightness of 5% or less.

Furthermore, as shown in FIGS. 17 and 18, it is possible to further improve the effectiveness by making the surface area of line parts 4*c* and 5*c* larger than that of the other line parts, as this serves to increase the percentage of current reduction with respect to the overall discharge current when auxiliary ribs 12 are applied to a structure in which the aperture ratio of the strong part of the discharge is increases while maintaining the surface area of display electrodes 4 and 5.

When the surface area of the outer most line parts 4*c* and 5*c* is enlarged in the prior art having no auxiliary ribs 12, crosstalk readily occurs due to the further excess electrostatic capacity in line parts 4*c* and 5*c* due to the distance between adjacent cells being shortened. In contrast, according to embodiment 8, crosstalk is suppressed because of the electrostatic capacity of line parts 4*c* and 5*c* being suitably reduced.

Here, although FIGS. 17 and 18 show examples of when display electrodes 4 and 5 are formed entirely from a metal, the same effects can be achieved, even when display electrodes 4 and 5 are constituted in part by transparent electrodes.

Furthermore, the form of display electrodes 4 and 5 is not limited to the belt-shape shown in FIGS. 17 and 18, and the form of auxiliary ribs 12 is likewise not limited to a rectangular-shape.

Furthermore, the positioning of auxiliary ribs 12 is not limited to being directly below the outer most line parts 4*c* and 5*c*, and power reductions are achievable, even when auxiliary ribs 12 are arranged in the y direction on the immediate outside of line parts 4*c* and 5*c*. This is to extend the electric field distribution to the outer side of display electrodes 4 and 5 by the existence of dielectric layer 6 covering display electrodes 4 and 5. The discharge does not expand any further when auxiliary ribs 12 are disposed on the immediate outside of the outer most line parts 4*c* and 5*c*, and thus power reductions are considerable.

Embodiment 9

Figure 20:
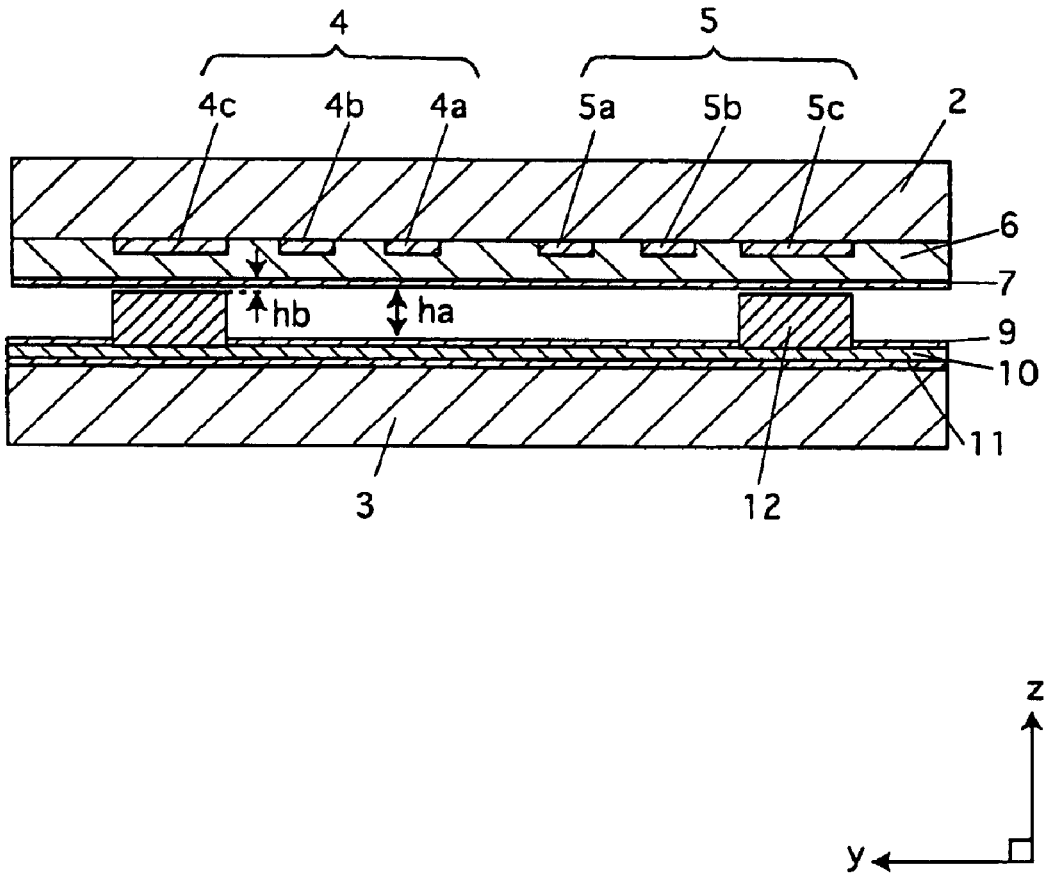
FIG. 20 is a cross-sectional view of a PDP according to an embodiment 9.

FIG. 20 is a cross-sectional view of a PDP according to an embodiment 9.

A difference with embodiment 8 is a lowering of the height hb of the discharge space facing the outer most line parts 4*c* and 5*c*, this being achieved by forming wall-shaped phosphor layers 13 instead of altering the height of auxiliary ribs 12. Substantially the same effects to those of embodiment 8 can be achieved, even with this structure.

Embodiment 10

Figure 21:
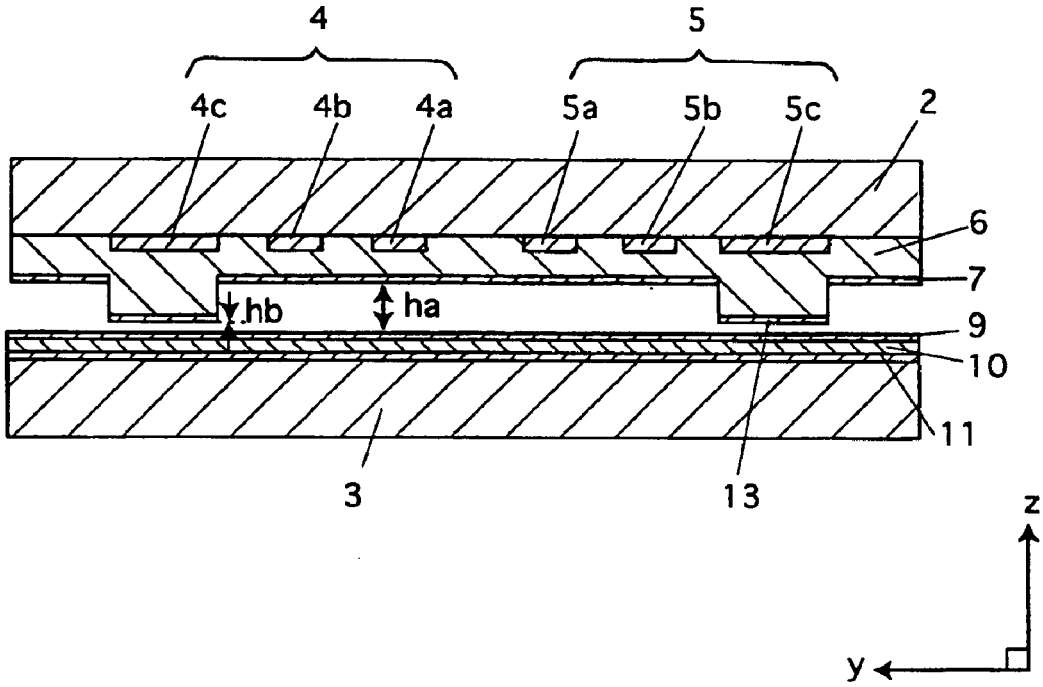
FIG. 21 is a cross-sectional view of a PDP according to an embodiment 10.

FIG. 21 is a cross-sectional view of a PDP according to an embodiment 10.

In embodiment 10, a lowering of the height hb of the discharge space facing the outer most line parts 4*c* and 5*c* is achieved by locally increasing the thickness of dielectric layer 6 covering the outer most line parts 4*c* and 5*c*. Substantially the same effects to those of embodiment 8 can be achieved, even with this structure.

Embodiment 11

Figure 22:
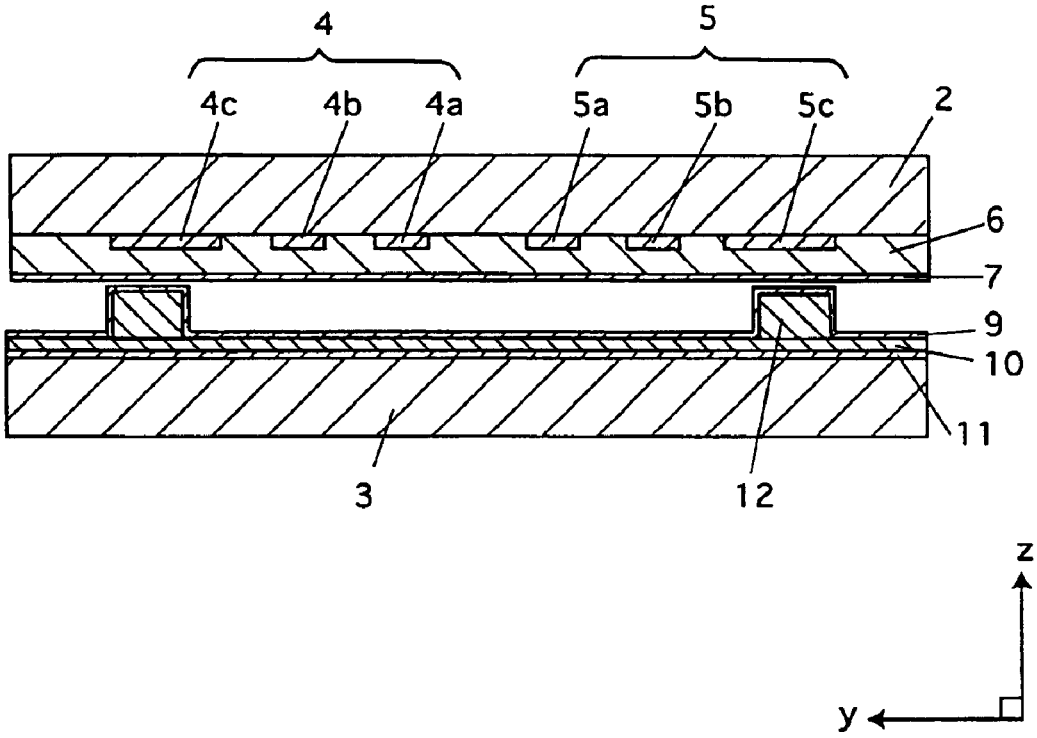
FIG. 22 is a cross-sectional view of a PDP according to an embodiment 11.

FIG. 22 is a cross-sectional view of a PDP according to an embodiment 11.

Figure 23:
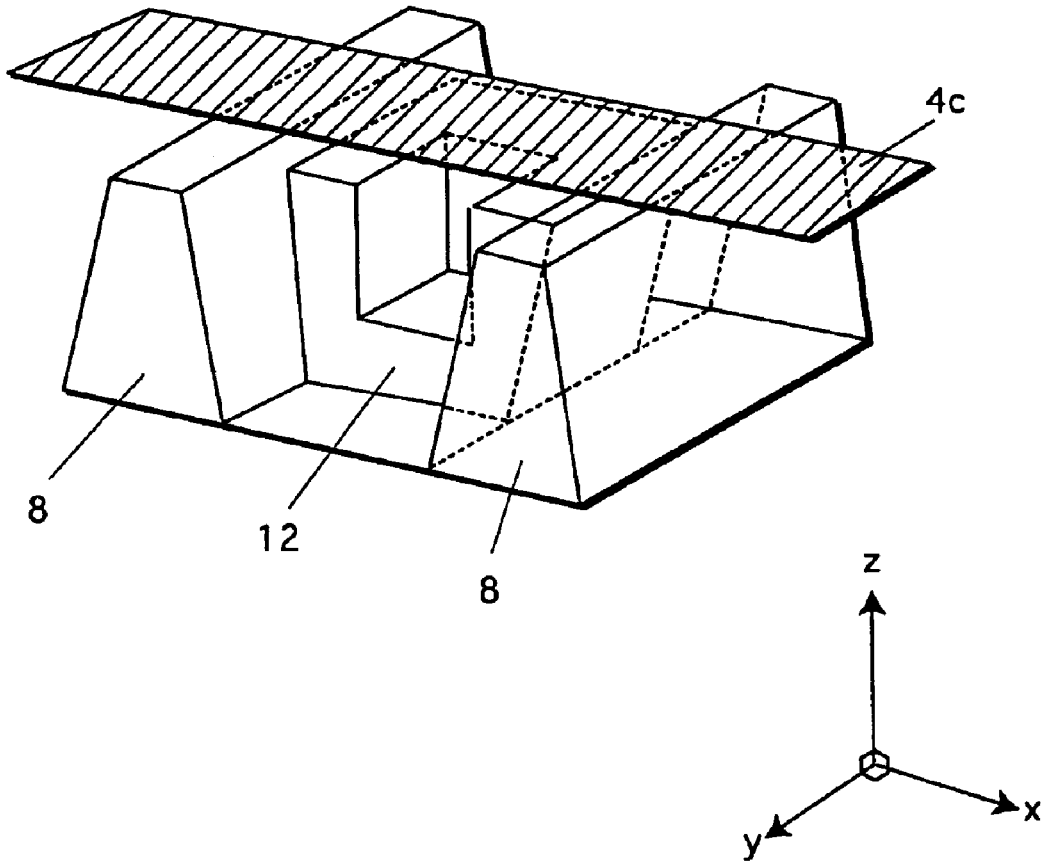
FIG. 23 shows a variation of the auxiliary rib.

In embodiment 11, the height of the discharge space facing the outer most line parts 4*c* and 5*c* is partially lowered. A difference with embodiment 8 is that auxiliary ribs 12 do not completely cover the outer most line parts 4*c* and 5*c*. This seeks to prevent a weakening of the electric field from line parts 4*c* and 5*c* that results from the lowering the discharge space height, and the discharge space near to where plasma is generated at a time of the discharge is provided to be sufficiently high. Having the outer most line parts 4*c* and 5*c* partially face the discharge space means that the discharge space has two or more different heights. Excellent effects can be achieved, even if auxiliary ribs 12 are formed in the shape shown in FIG. 23, for example.

Here, while the discharge space facing the outer most line parts 4*c* and 5*c* is lowered by forming auxiliary ribs 12 as in embodiment 8, the effects of embodiment 8 do not depend on the means of adjusting the height of the discharge space. In other words, excellent effects can be obtained by any of the methods shown in embodiments 8 to 10.

Embodiment 12

Figure 24:
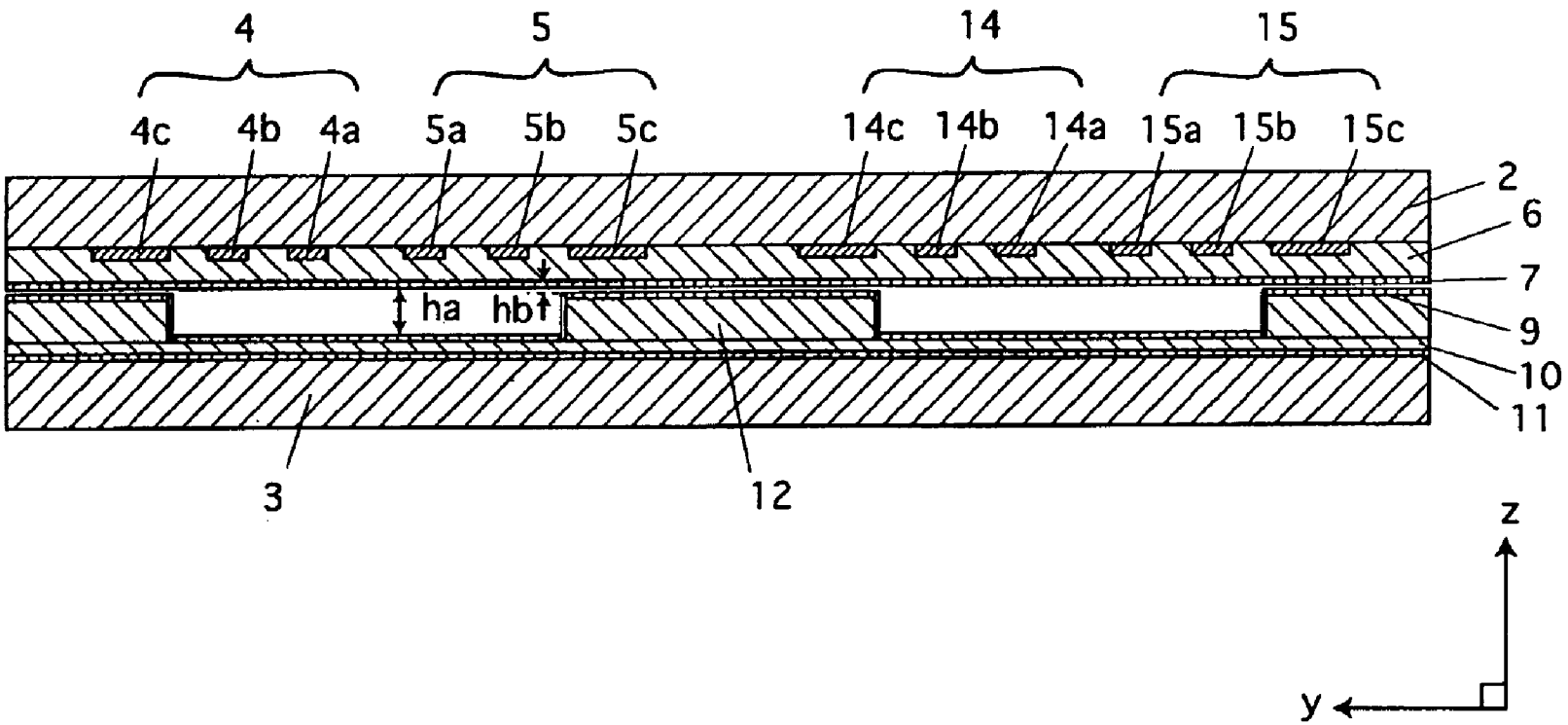
FIG. 24 is a cross-sectional view of a PDP according to an embodiment 12.

FIG. 24 is a cross-sectional view of a PDP according to an embodiment 12.

In embodiment 12, the discharge space between cells adjacent in the y direction is narrowed by filling the space with auxiliary ribs 12.

In FIG. 24, crosstalk may occur between display electrodes 4 and 5 and display electrodes 14 and 15 if auxiliary ribs are not provided. In particular, when the surface area of the outermost line parts 14*c* and 5*c* is widened, as in FIG. 24, the accumulation of wall charge on the dielectric layer in a vicinity of line parts 14*c* and 5*c* increases and crosstalk readily occurs, because of increases in the electrostatic capacity of these line parts and the shortening of the distance between the cells.

Here, in embodiment 12, the electrostatic capacity of line parts 14*c* and 5*c* is cut, in addition to cutting the discharge current of line parts 14*c* and 5*c*, and as a means of preventing crosstalk, auxiliary ribs 12 are provided to span from line part 14*c* to line part 5*c*, and the height of the discharge space is limited so as to overlap the discharge in this area.

Figure 25:
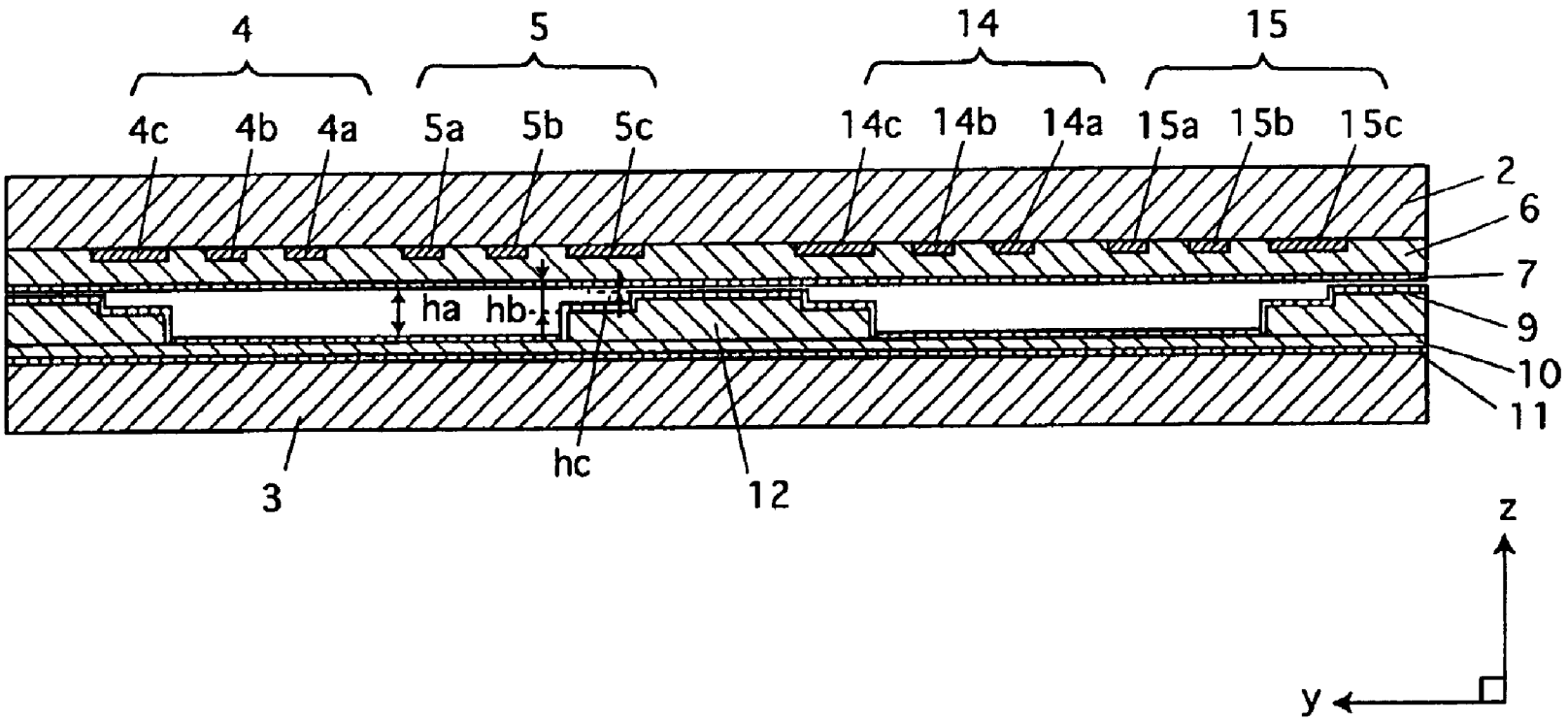
FIG. 25 is a cross-sectional view of the PDP showing a variation of embodiment 12.

In embodiment 12, it is not necessary for the discharge space height hb facing line parts 4*c*, 5*c* and the like to be the same as a discharge space height hc between the cells, and auxiliary ribs 12 may be formed, for example, in a stepped-shape, as shown in FIG. 25.

Here, while the discharge space height facing line parts 4*c* and 5*c* and the discharge space height between the cells is lowered by forming auxiliary ribs 12 as in embodiment 8, the effects of embodiment 12 do not depend on the means of limiting the height of the discharge space.

Embodiment 13

Figure 26:
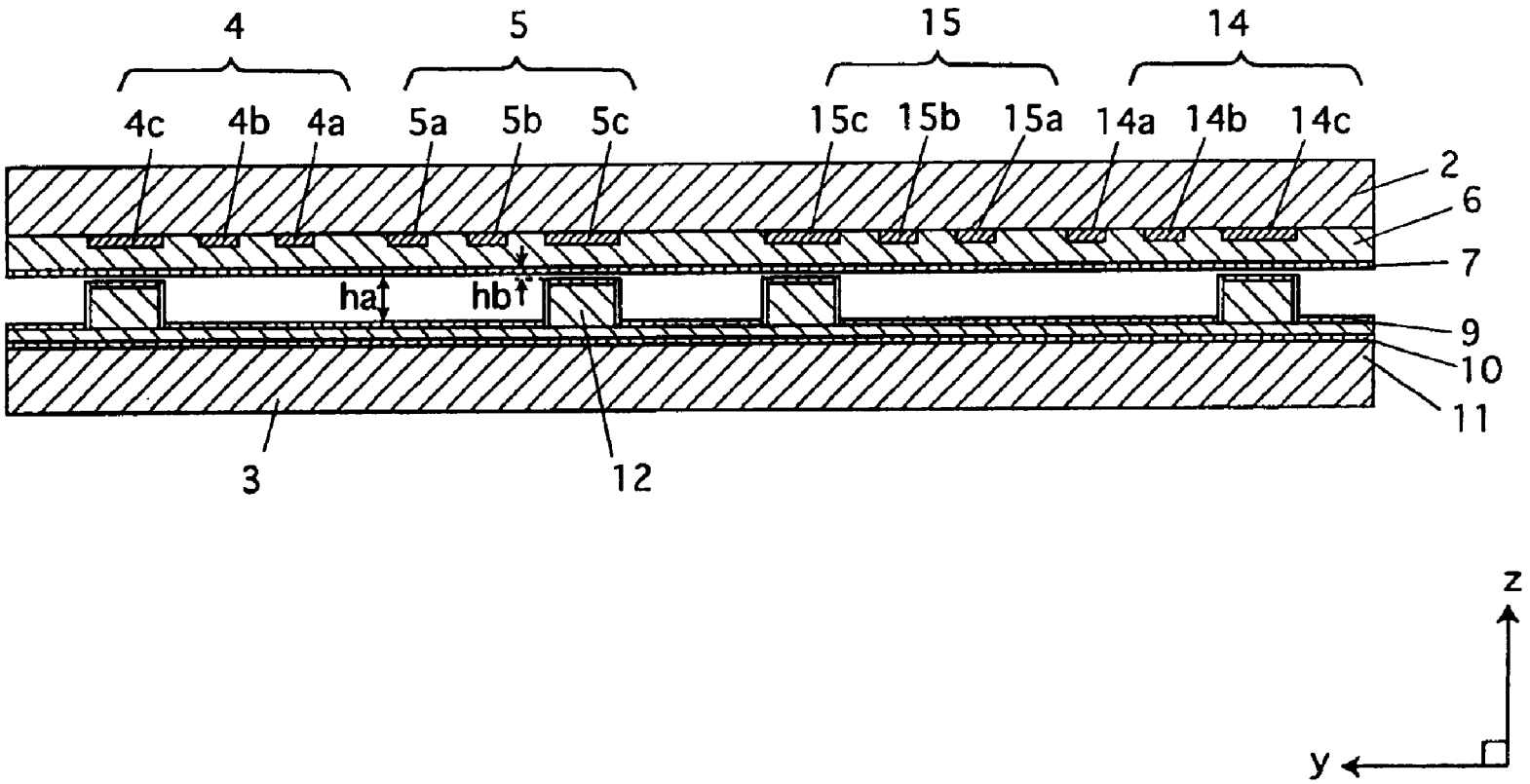
FIG. 26 is a cross-sectional view of a PDP according to an embodiment 13.

FIG. 26 is a cross-sectional view of a PDP according to an embodiment 13.

In embodiment 13, as shown in FIG. 26, the structure of embodiment 8 is supplemented by sustain electrodes 5 and 15 and scan electrodes 4 and 14 being arranged next to each other in two cells adjacent in the y direction. This is so that electrodes positioned next to each other in adjacent cells always have the same potential in the discharge sustain period.

The method of arranging the electrodes as described above is known not only to prevent crosstalk, but also to reduce the sum total of electrostatic capacity between scan electrode 4 and other electrodes in the same electrode group (e.g. scan electrode 14) and sustain electrodes 5 and other electrodes in the same electrode group (e.g. sustain electrode 15).

However, in the case of a structure such as in the present embodiment, where the display electrodes are divided into line parts or the like, crosstalk occurs relatively easily. This is because a discharge that expands, for example, from the main discharge gap to line part 5*c* readily transfers to line part 15*c*. As a result, wall charge in a vicinity of line part 14*c* is erased, and a sustain discharge can no longer be generated in the cell corresponding to the adjacent pair of display electrodes 14 and 15.

Furthermore, when the surface area of the outer most line parts 5*c* and 15*c* is widened, crosstalk readily occurs, particularly because of the accumulation of wall charge around these line parts being unsettled.

Here, in embodiment 13, by providing barrier ribs directly below the outer most line parts 5*c* and 15*c*, and by lowering the height of the discharge space facing these line parts, the electrostatic capacity of these line parts is reduced, and the accumulation of wall charge is concentrated around the main discharge gap in a central part of the cell, and thus crosstalk does not readily occur. Moreover, it is possible to reduce the sum total of electrostatic capacity between scan electrode 4 and other electrodes in the same electrode group (e.g. scan electrode 14) and sustain electrodes 5 and other electrodes in the same electrode group (e.g. sustain electrode 15).

Figure 27:
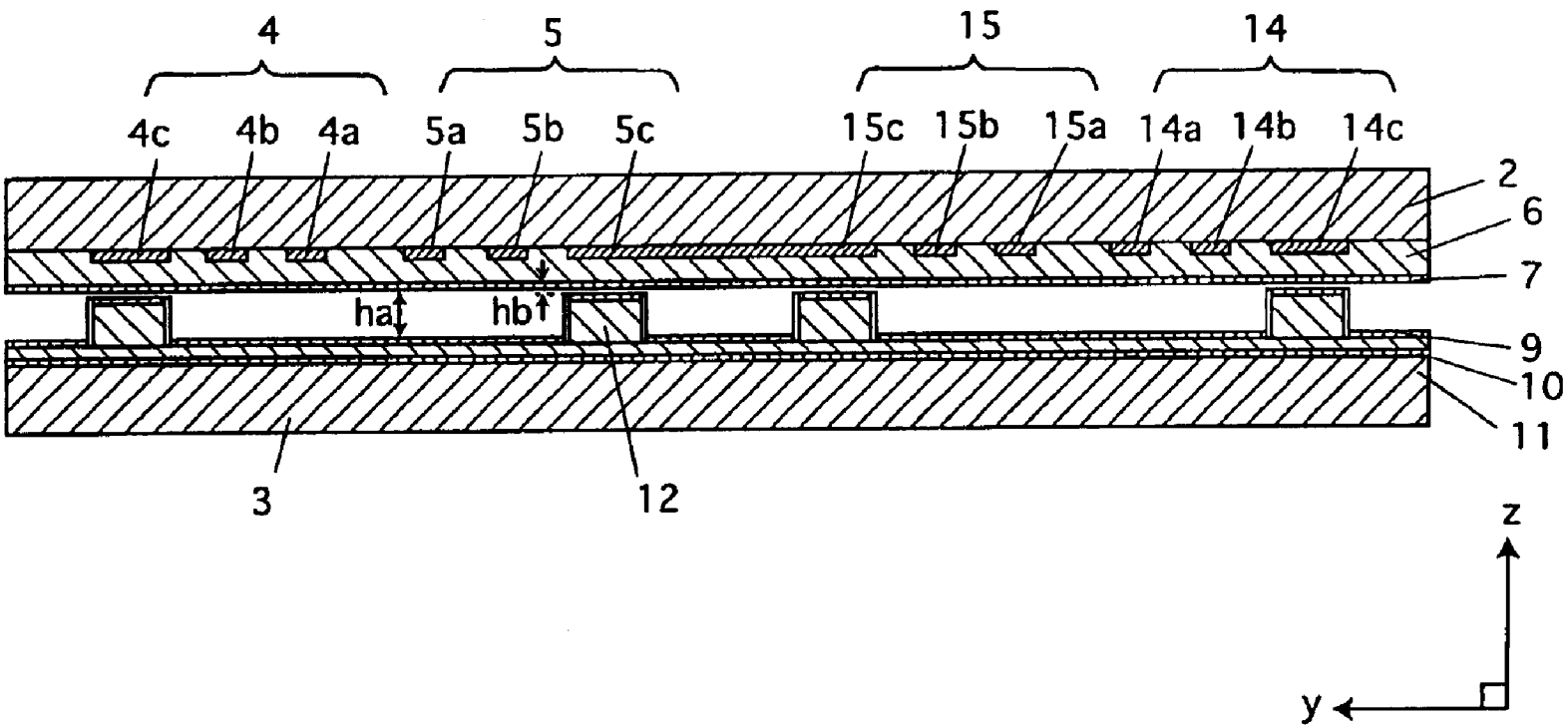
FIG. 27 is a cross-sectional view of the PDP showing a variation of embodiment 13.
Figure 28:
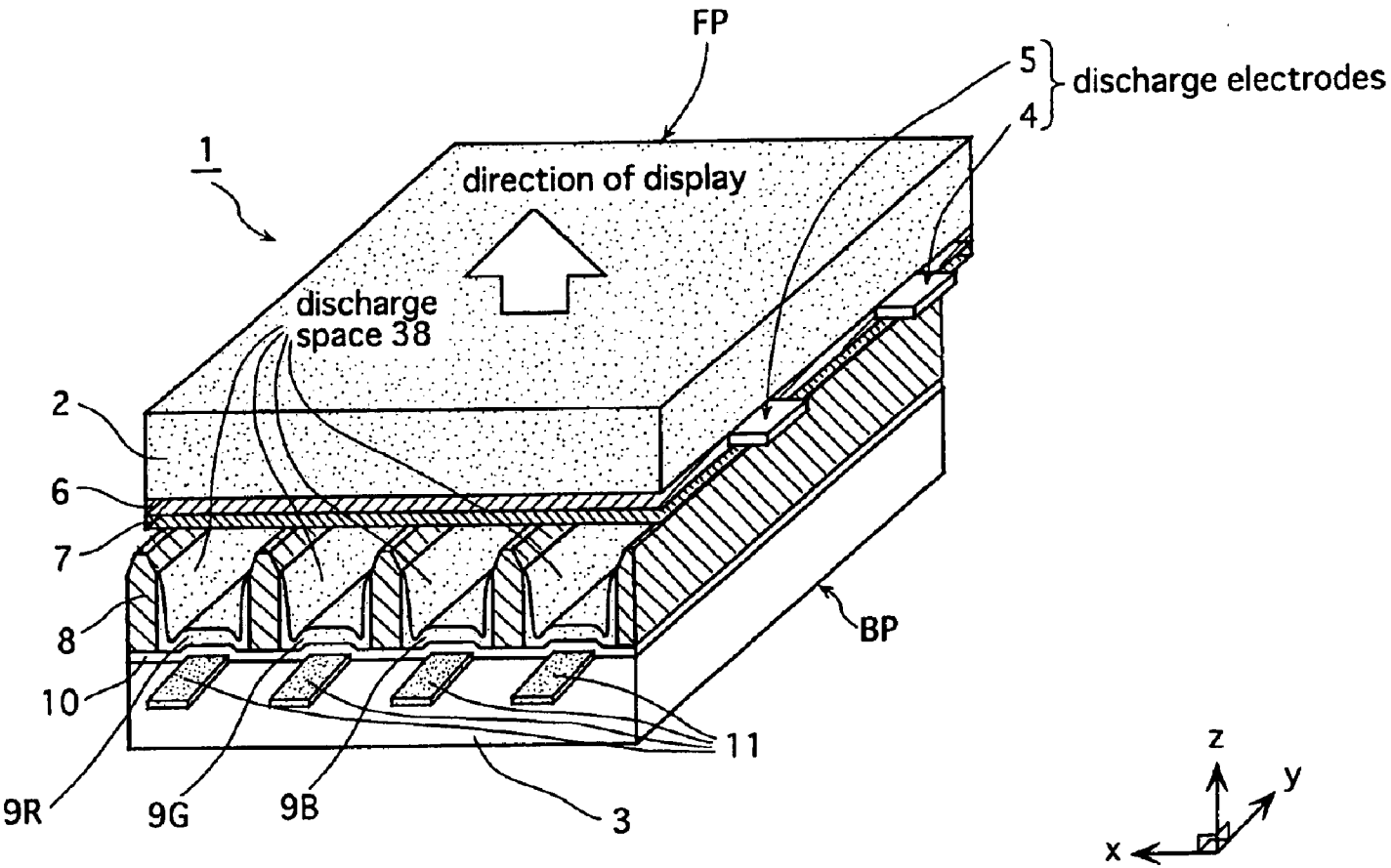
FIG. 28 is a partial cross-sectional perspective view of a main structure of a conventional AC-type surface discharge PDP.
Figure 29:
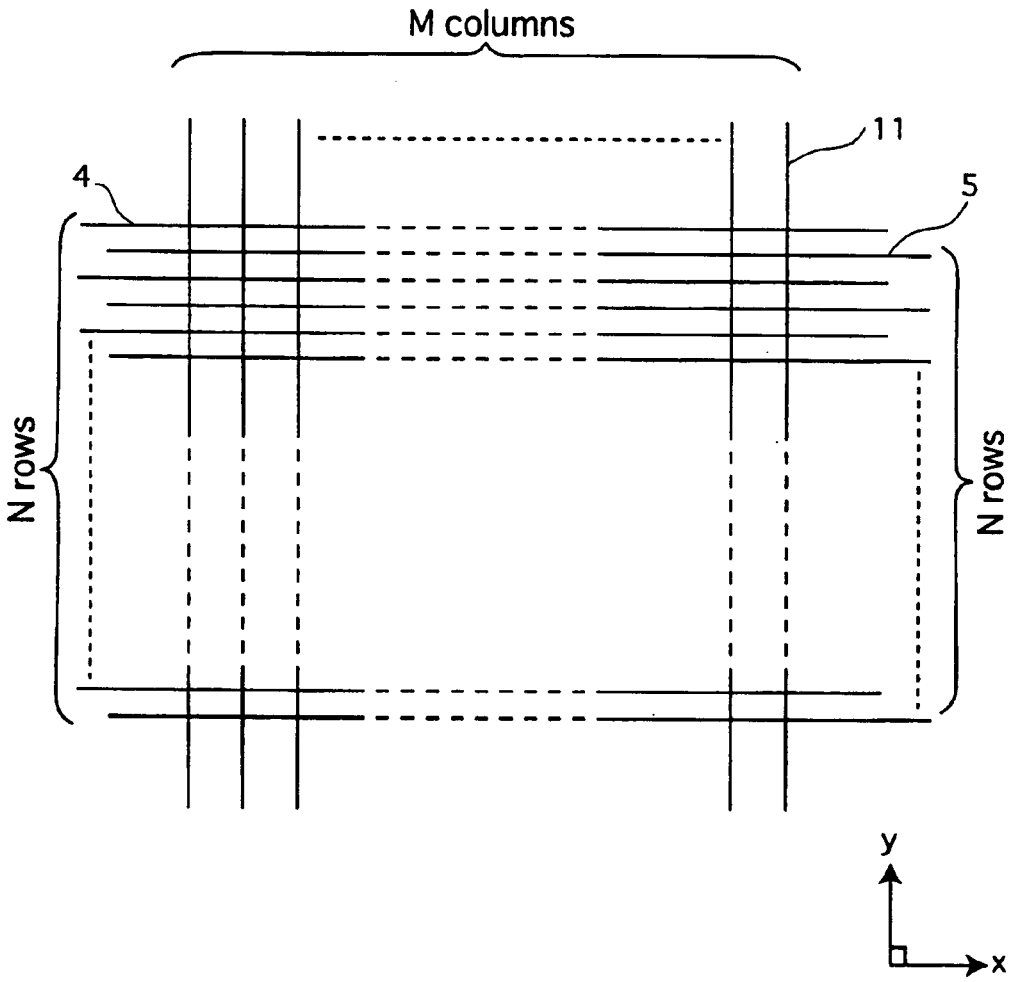
FIG. 29 shows a matrix formed from plural pairs of display electrodes 4 and 5 (N rows) and a plurality of address electrodes (M columns) in a PDP.

Here, in embodiment 13, as shown in FIG. 27, by electrically connecting the outermost line parts 5*c* and 15*c*, it is possible to reduce the resistance value of these line parts.

Furthermore, although in the given example an auxiliary rib 12 is only formed directly beneath the outermost line parts 5*c* and 15*c*, the present invention is not limited to this structure. In other words, the height of the discharge space may be limited by wall-shaped phosphor layers 13 (see FIG. 20) or dielectric layer 6 (see FIG. 21), or a single auxiliary rib 12 (see FIGS. 24, 25) maybe formed to span between adjacent cells.

Furthermore, the combination of the line parts and the black films of embodiments 4 to 6 may be applied to the other embodiments. It is thus possible to realize the effects disclosed in these embodiments while at the same time maintaining a high contrast performance capacity.

INDUSTRIAL APPLICABILITY

The present invention is applicable in televisions, and in particular, high-vision televisions capable of high definition image reproduction.

What is claimed is:

1. A gas discharge panel having plural pairs of display electrodes disposed so as to extend through a plurality of cells, each pair being formed from a sustain electrode and a scan electrode, wherein the sustain and scan electrodes each include a plurality of line parts, and an aggregate width of the line parts included in the sustain and scan electrodes is in a range of 22% to 48% inclusive of pixel pitch.

2. The gas discharge panel of claim 1, wherein the width of each of the line parts is in a range of 2.8% to 6% inclusive of pixel pitch.

3. The gas discharge panel as in claim 2, wherein at least one of the plurality of line parts included in each of the sustain and scan electrodes is made from a metallic material.

4. The gas discharge panel of claim 2, wherein the sustain and scan electrodes each include at least four line parts.

5. The gas discharge panel as in claim 4, wherein at least one of the plurality of line parts included in each of the sustain and scan electrodes is made from a metallic material.

6. The gas discharge panel of claim 4, wherein the width of a line part closest to a discharge gap between the sustain and scan electrodes in each pair is in a range of 1% to 6% inclusive of pixel pitch.

7. The gas discharge panel as in claim 6, wherein the width of a line part farthest from the discharge gap in each of the sustain and scan electrodes is the greatest of the plurality of line parts.

8. The gas discharge panel as in claim 6, wherein at least one of the plurality of line parts included in each of the sustain and scan electrodes is made from a metallic material.

9. The gas discharge panel of claim 6, wherein the width of a line part second closest to the discharge gap in each of the sustain and scan electrodes is in a range of 1% to 6% inclusive of pixel pitch.

10. The gas discharge panel as in claim 9, wherein the width of a line part farthest from the discharge gap in each of the sustain and scan electrodes is the greatest of the plurality of line parts.

11. The gas discharge panel of claim 9, wherein the width of a line part third closest to the discharge gap in each of the sustain and scan electrodes is in a range of 1% to 6% inclusive of pixel pitch.

12. The gas discharge panel as in claim 11, wherein the width of a line part farthest from the discharge gap in each of the sustain and scan electrodes is the greatest of the plurality of line parts.

13. The gas discharge panel as in claim 1, wherein at least one of the plurality of line parts included in each of the sustain and scan electrodes is made from a metallic material.

14. The gas discharge panel of claim 13, wherein all of the line parts in each of the sustain and scan electrodes are made from a metallic material.

15. A gas discharge panel having plural pairs of display electrodes disposed on a surface of a substrate, so as to extend through a plurality of cells, each pair being formed from a sustain electrode and a scan electrode, wherein the sustain and scan electrodes each include a plurality of line parts, and a black film is formed on the surface of the substrate in a position corresponding to where the plurality of line parts will be disposed.

16. The gas discharge panel of claim 15, wherein the sustain and scan electrodes each include a connector part that connects two adjacent line parts, and the black film is formed on the surface of the substrate in a position corresponding to where the connector part will be disposed.

17. The gas discharge panel of claim 16, wherein the black film is made from a dielectric material.

18. The gas discharge panel of claim 16, wherein the black film is made from an insulating material.

19. The gas discharge panel of claim 18, wherein the black film is made from an insulating material used for a black stripe.

20. The gas discharge panel of claim 15, wherein the black film is wider than the line parts to be layered over the black film.

21. The gas discharge panel of claim 15, wherein the black film is formed to at least span two adjacent line parts.

22. The gas discharge panel of claim 21, wherein the black film is formed to at least span from a line part farthest from a discharge gap between the sustain and scan electrode in each pair to a line part second closest to the discharge gap.

23. The gas discharge panel of claim 15, wherein the black film is formed to span the line parts farthest from a discharge gap between the sustain and scan electrode in each of two pairs of display electrodes adjacent in a direction orthogonal to a lengthwise direction of the line parts.

24. The gas discharge panel of claim 23, wherein a height of a space corresponding to the black film in a cell is lower than in other areas of the cell.

25. A gas discharge panel in which a plurality of cells having a discharge space are arranged in a matrix between a pair of substrates, and plural pairs of display electrodes are disposed on a facing surface of one of the substrates, so as to extend through the plurality of cells, each pair being formed from a sustain electrode and a scan electrode arranged with a discharge gap therebetween, wherein a plurality of first barrier ribs are arranged side-by-side between the pair of substrates, so as to extend in a row direction of the matrix, a second barrier rib is disposed between cells adjacent in the row direction of the matrix, so as to extend along a column direction of the matrix, the sustain and scan electrodes each include a plurality of line parts that extend in the column direction of the matrix, and the second barrier rib and a line part farthest from the discharge gap are positioned so as to overlap with a space therebetween.

26. The gas discharge panel of claim 25, wherein the sustain and scan electrodes each include a connector part that connects two adjacent line parts.

27. The gas discharge panel as in claim 26, wherein a phosphor layer is formed on a surface on the first and second barrier ribs that faces into the discharge space.

28. The gas discharge panel of claim 25, wherein the second barrier rib is shorter in height than the first barrier ribs.

29. The gas discharge panel as in claim 28, wherein a phosphor layer is formed on a surface on the first and second barrier ribs that faces into the discharge space.

30. The gas discharge panel as in claim 25, wherein a phosphor layer is formed on a surface on the first and second barrier ribs that faces into the discharge space.

31. The gas discharge panel of claim 25, wherein a dielectric layer is formed on the surface of the substrate on which the display electrodes are formed, and the second barrier rib is formed from a partially thickened area of the dielectric layer.

32. The gas discharge panel of claim 25, wherein a width of a line part farthest from the discharge gap in each of the sustain and scan electrodes is the greatest of the plurality of line parts.

33. The gas discharge panel of claim 25, wherein the second barrier rib corresponds to (i) line parts positioned closest to each other in two cells adjacent in the row direction of the matrix, and (ii) a gap between the closest line parts, and a height of the second barrier rib in the gap between the closest line parts is greater than in other areas.

34. The gas discharge panel of claim 25, wherein a polarity of two line parts that are adjacent between two cells adjacent in the row direction of the matrix is equal.

* * * * *